US007819440B2

(12) United States Patent
Schwickerath

(10) Patent No.: US 7,819,440 B2
(45) Date of Patent: Oct. 26, 2010

(54) POWER LOCKING HANDLE FOR A MOVABLE CLOSURE ELEMENT

(75) Inventor: Toby Schwickerath, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 729 days.

(21) Appl. No.: 11/700,484

(22) Filed: Jan. 31, 2007

(65) Prior Publication Data

US 2008/0178646 A1 Jul. 31, 2008

(51) Int. Cl.
*E05C 3/06* (2006.01)
*E05C 3/00* (2006.01)

(52) U.S. Cl. ..... 292/201; 292/280; 292/DIG. 31; 70/210; 70/224

(58) Field of Classification Search ..... 292/201, 292/280, 336.3, DIG. 31; 70/210, 224, 278.7, 70/279.1, 283
See application file for complete search history.

(56) References Cited

U.S. PATENT DOCUMENTS 1,833,572 A * 11/1931 Hardesty ..... 70/262
2,317,700 A * 4/1943 Thompson ..... 292/254
3,096,114 A * 7/1963 Trammell, Jr. ..... 292/336.3
4,030,322 A * 6/1977 Pettit ..... 70/159
4,093,289 A * 6/1978 Inabayashi et al. ..... 292/336.3
5,058,258 A * 10/1991 Harvey ..... 29/401.1
5,265,452 A 11/1993 Dawson et al.
6,490,896 B2 * 12/2002 Segawa ..... 70/208
6,523,377 B1 2/2003 Vonlanthen
6,668,602 B2 * 12/2003 Graham et al. ..... 70/208
6,794,572 B1 * 9/2004 Chiang ..... 174/50
6,840,552 B2 * 1/2005 Ramsauer ..... 292/336.3
7,013,689 B2 * 3/2006 Graham et al. ..... 70/208
7,040,125 B2 * 5/2006 Ciezki et al. ..... 70/208
7,089,770 B2 * 8/2006 Ramsauer et al. ..... 70/208
7,152,441 B2 * 12/2006 Friar et al. ..... 70/78

(Continued)

FOREIGN PATENT DOCUMENTS

DE 3313100 A1 * 8/1984

(Continued)

OTHER PUBLICATIONS

UK Intellectual Property Office Search Report dated May 6, 2008 for corresponding Application No. GB0800499.6.

*Primary Examiner*—Carlos Lugo
(74) *Attorney, Agent, or Firm*—Wood, Phillips, Katz, Clark & Mortimer

(57) ABSTRACT

A system for releasably maintaining a movable closure element in a predetermined position relative to a support therefor. The latch assembly is changed from a latched state into an unlatched state as an incident of the first actuator assembly being changed from a normal state into a release state. The first actuator assembly has a first handle that is repositionable relative to a base assembly between first and second positions. The first actuator assembly is in the normal state with the first handle in the first position and the release state with the first handle in the second position. The lock assembly cooperates with the first actuating assembly and in a locked state prevents the first handle from being changed from the first position into the second position. The lock assembly has a motor that is actuatable to change the lock assembly between the locked and unlocked states.

38 Claims, 13 Drawing Sheets

U.S. PATENT DOCUMENTS

| | | | | |
|---|---|---|---|---|
| 7,194,881 | B2 * | 3/2007 | Kutschat | 70/224 |
| 7,309,087 | B2 * | 12/2007 | Lane et al. | 292/216 |
| 2002/0152778 | A1 | 10/2002 | Segawa | |
| 2004/0099026 | A1 | 5/2004 | Nunez | |
| 2005/0279144 | A1 | 12/2005 | Kutschat | |
| 2007/0240463 | A1 | 10/2007 | Antonucci | |

FOREIGN PATENT DOCUMENTS

| | | | |
|---|---|---|---|
| DE | 3407125 | A1 * | 9/1985 |
| DE | 19642698 | | 4/1998 |
| DE | 29806974 | | 7/1998 |
| DE | 10/2004009366 | | 9/2005 |
| EP | 0133815 | | 3/1985 |
| EP | 1214491 | | 3/2001 |
| EP | 1568832 | | 2/2005 |
| GB | 2144794 | | 3/1985 |

* cited by examiner

POWER LOCKING HANDLE FOR A MOVABLE CLOSURE ELEMENT

BACKGROUND OF THE INVENTION

1. Field of the Invention

This invention relates to latch systems of the type used to releasably maintain a movable closure element in a predetermined position and, more particularly, to a latch system incorporating a pull handle that can be selectively locked through the use of a motor.

2. Background Art

Myriad latch systems currently exist for releasably maintaining movable closure elements in at least one predetermined position. Typically, the closure element will have open and closed states, at least one of which is releasably maintained by the latch system. Closure elements of this type are used in many different environments for both static and dynamic applications. As an example of the latter application, latch systems are used on primary access doors on passenger vehicles, and on other types of vehicles including those used on- and off-road, as in the construction trades and the agricultural industry.

One known design of latch system that is useable as described above is disclosed in U.S. Pat. No. 7,097,216, commonly owned herewith. The latch system shown therein is a general application system, including an actuator assembly on one side in the form of a "pull handle", that can be grasped and repositioned to change the state of a latch assembly from a latched state into an unlatched state. The latch assembly is designed to cooperate with a strike element on a frame relative to which the closure element is guidingly moved. In the latched state, the latch assembly maintains the closure element in its closed position. In the unlatched state, the closure element is allowed to move from the closed position into the open position. Through the pull handle, on the one side of the closure element, the state of the latch assembly can be changed.

More particularly, the actuator assembly consists of a base assembly relative to which the pull handle is selectively repositionable by a user between first and second positions. As an incident of changing the pull handle from its first position into its second position, the latch assembly is changed from its latched state into its unlatched state. The actuator assembly is typically mounted so that a force produced on the pull handle, resulting from the same user motion that repositions the pull handle from its first position into its second position, causes the closure element to be moved from its closed position towards its open position as the repositioning force on the pull handle is continuously applied by a user.

Actuator assemblies of the type described in U.S. Pat. No. 7,097,216 will normally have a lock feature that both: a) prevents inadvertent repositioning of the pull handle as might detrimentally change the state of the latch assembly into its unlatched state; and b) prevents unauthorized access to a space or compartment through the particular opening bounded by the closure element through repositioning of the pull handle.

Heretofore, the locking of pull handles on actuator assemblies of the type shown in U.S. Pat. No. 7,097,216 has been accomplished manually, through the use of a key. While, for most purposes, the ability to manually lock and unlock the actuator assembly is adequate, there are many situations that may present themselves, or conditions that may be encountered, wherein the manual control is deficient.

Heretofore, the industry has lacked a practical way to incorporate powered locking through a pull handle actuator assembly of the type described above. The industry continues to seek practical and innovative designs that address this yet unmet need.

SUMMARY OF THE INVENTION

In one form, the invention is directed to a system for releasably maintaining a movable closure element in a predetermined position relative to a support therefor. The system includes a latch assembly to engage a part of a support for the movable closure element, on which the system is mounted, and has a latched state and an unlatched state. A first actuator assembly has a normal state and a release state. The first actuator assembly and latch assembly are operatively interconnected so that the latch assembly is changed from the latched state into the unlatched state as an incident of the first actuator assembly being changed from the normal state into the release state. The first actuator assembly has a base assembly and a first handle that is repositionable relative to the base assembly between first and second positions. The first actuator assembly is in the normal state with the first handle in the first position and in the release state with the first handle in the second position. The system further includes a lock assembly having a locked state and an unlocked state. The lock assembly cooperates with the first actuating assembly and a) in the locked state prevents the first handle from being changed from the first position into the second position; and b) in the unlocked state allows the first handle to be changed from the first position into the second position. The lock assembly has a motor that is actuatable to change the lock assembly between the locked and unlocked states.

In one form, the first handle is part of a first assembly that moves as one piece relative to the base assembly. The lock assembly in the locked state directly engages the first assembly to prevent the first handle from being moved from the first position into the second position.

The first assembly may be pivotable around a first axis relative to the base assembly.

The lock assembly may include a lock cam that is movable around a second axis between a locked position, with the lock assembly in the locked state, and an unlocked position with the lock assembly in the unlocked state.

In one form, the first and second axes are transverse to each other.

In one form, the first assembly has a receptacle bounded by a shoulder. With the lock assembly in the locked state, the lock cam is situated to abut the shoulder to thereby block movement of the first handle from the first position into the second position.

In one form, the motor has a shaft with a drive element. The lock cam is directly engaged by the drive element so that as the motor is actuated, the lock cam is changed between the locked and unlocked positions.

In one form, the drive element and lock cam each has teeth that are directly meshed with each other.

In an alternative form, a reduction gear has teeth in mesh with teeth on each of the drive element and lock cam.

In one form, the lock assembly includes a manual actuator subassembly that is operable to change the lock assembly between the locked and unlocked states.

The manual actuator subassembly may be in the form of a key operated lock plug.

The key operated lock plug may be in the form of a housing with a cylinder that accepts an access key. The cylinder can be pivoted around an axis through the access key to thereby change an actuating projection between locking and unlocking positions. The actuating projection cooperates with the lock cam to cause the lock cam to be changed from the unlocked position into the locked position as an incident of the actuating projection being changed from the unlocking position into the locking position.

The actuating projection and the lock cam are configured to define a lost motion connection therebetween, whereby the lock cam can be changed between the locked and unlocked positions through actuation of the motor without repositioning the actuating projection between the locking and unlocking positions.

In one form, there are cooperating detent components on the lock cam and base assembly that interact as an incident of the cam lock being changed from the locked position into the unlocked position to inhibit movement of the lock cam from the locked position.

In one form, the base assembly consists of a housing defining a compartment for the motor. At least one opening is provided in the housing to allow egress of moisture from the compartment.

The base assembly has a wall portion defining a chamber. The housing with the motor therewithin is mounted within the chamber.

In one form, the housing, motor and lock cam define a self-contained module that can be mounted to the wall portion within the chamber.

The manual actuator subassembly may also be part of the self-contained module.

In one form, the first actuator assembly has a front and rear. The wall portion has a cup shape opening rearwardly. The self-contained module is configured to be assembled by being directed from rear to front into the chamber and into an assembled state wherein the lock plug is exposed to be operated at the front of the actuator assembly.

The base assembly may further include a mounting wall that is integral with the wall portion and defines a mounting surface that can be placed facially against a movable closure element to mount the first actuator assembly to the movable closure element.

In one form, the first handle is configured to be surroundingly grasped by a hand of user and is mounted to the mounting wall for pivoting movement relative to the mounting wall between the first and second positions.

In one form, the first handle has a cantilevered projection that extends into the chamber. The cantilevered projection has a shoulder. The lock cam cooperates with the shoulder on the cantilevered projection to block movement of the first handle from the first position into the second position with the lock assembly in the locked state.

The wall portion and mounting wall may be formed as one piece.

The above system may be provided in combination with a movable closure element having first and second sides and a second actuator assembly. The first actuator assembly is mounted on the first side of the movable closure element, with the second actuator assembly mounted on the second side of the movable closure element. The second actuator assembly has normal and release states and is configured to change the latch assembly from the latched state into the unlatched state as an incident of the second actuator assembly being changed from its normal state into its release state.

In one form, the cantilevered projection is moved in a substantially linear path as the first actuator assembly is changed between its normal and release states. The second actuator is in the form of a push button actuator with a translatable component that causes the cantilevered projection to move in the substantially linear path as the second actuating assembly is changed between its normal and release states.

The system may be further provided in combination with a vehicle and a movable closure element on the vehicle to which the closure element is mounted for movement between open and closed positions. A secondary actuator assembly causes the motor to be automatically controlled in response to the detection of a condition that warrants either: a) maintaining of the state of the lock assembly; or b) changing of the state of the lock assembly.

In one form, the condition that warrants changing of the state of the lock assembly may be any one or more of: a) an external force resulting from an impact to the vehicle; b) situation of the closure element in a partially closed state; c) situation of the closure element in the open position; d) malfunction of a component of the vehicle; e) the presence of excessive heat; f) the presence of smoke; and g) the presence of an obstruction that interferes with movement of the closure element.

The system may be further provided in combination with a remote secondary actuator assembly through which the motor can be actuated.

The invention is further directed to an actuator assembly module having a first actuator assembly with a normal state and a release state. The first actuator assembly is configured to be operatively interconnected with a latch assembly to thereby operate the latch assembly by changing the state of the first actuator assembly. The first actuator assembly has a base assembly and a first handle that is repositionable relative to the base assembly between first and second positions. The first actuator assembly is in the normal state with the first handle in the first position and in the release state with the first handle in the second position. The actuator assembly module further includes a lock assembly having a locked state and an unlocked state. The lock assembly cooperates with the first actuating assembly and: a) in the locked state prevents the first handle from being changed from the first position into the second position; and b) in the unlocked state allows the first handle to be changed from the first position into the second position. The lock assembly has a motor that is actuatable to change the lock assembly between the locked and unlocked states.

In one form, the first handle is part of a first assembly that moves as one piece relative to the base assembly. The lock assembly in the locked state directly engages the first assembly to prevent the first handle from being moved from the first position into the second position.

The first assembly may be pivotable around a first axis relative to the base assembly.

In one form, the lock assembly has a lock cam that is movable around an axis between a locked position with the lock assembly in the locked state and an unlocked position with the lock assembly in the unlocked state. The first assembly has a receptacle bounded by a shoulder and with the lock assembly in the locked state, the lock cam is situated to abut the shoulder to thereby block movement of the first handle from the first position into the second position.

The lock assembly may further include a manual actuator subassembly that is operable to change the lock assembly between the locked and unlocked states.

In one form, the manual actuator subassembly consists of a key operated lock plug, and the key operated lock plug has a housing with a cylinder that accepts an access key and can be pivoted around an axis through the access key to thereby change an actuating projection between locking and unlocking positions. The actuating projection cooperates with the lock cam to cause the lock cam to be changed from the unlocked position into the locked position as an incident of the actuating projection being changed from the unlocking position into the locking position.

In one form, the actuating projection and lock cam are configured to define a lost motion connection therebetween, whereby the lock cam can be changed between the locked and unlocked positions through actuation of the motor without repositioning the actuating projection between the locking and unlocking positions.

In one form, the base assembly has a wall portion defining a chamber and a housing defining a compartment for the motor. The housing is mounted within the chamber.

In one form, the housing, motor and lock cam define a self-contained module that can be mounted to the wall portion within the chamber.

In one form, the first actuator assembly has a front and rear and the wall portion has a cup shape opening rearwardly. The self-contained module is configured to be assembled by being directed from rear to front into the chamber into an assembled state wherein the lock plug is exposed to be operated at the front of the first actuator assembly.

The base assembly may further include a mounting wall that is integral with the wall portion and defines a mounting surface that can be placed facially against a movable closure element to mount the first actuator assembly to the movable closure element.

The first handle may be mounted to the mounting wall for pivoting movement relative to the mounting wall between the first and second position. The lock assembly in the locked state directly engages the first assembly to prevent the first handle from being moved from the first position into the second position.

In one form, the wall portion and mounting wall are formed as one piece.

In one form, the actuator assembly module may be provided in combination with a latch assembly with which the first actuator assembly is operatively interconnected.

DETAILED-DESCRIPTION OF THE DRAWINGS

Figure 1:
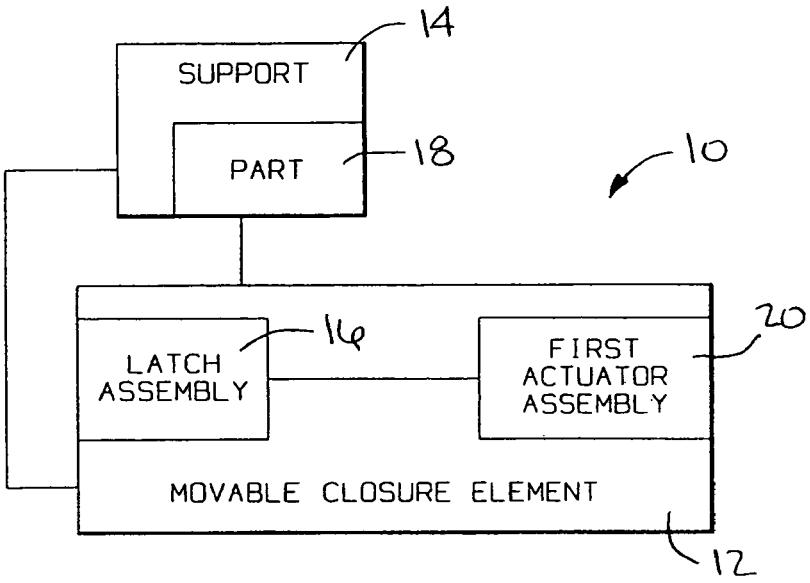
FIG. 1 is a schematic representation of a system, according to the present invention, for releasably maintaining a movable closure element in a predetermined position relative to a support therefor, and including a latch assembly operatively interconnected with a first actuator assembly.

In FIG. 1, a system, according to the present invention, is shown schematically at 10 for releasably maintaining a movable closure element 12 in a predetermined position relative to a support 14 therefor. The movable closure element 12 is guidingly movable relative to the support 14 between a plurality of different positions, such as an open position and a closed position. A latch assembly 16 is provided on the movable closure element 12 to engage a part 18 of the support 14, that may be a strike element, or the like. The latch assembly 16 has a latched state, in which the latch assembly 16 maintains the movable closure element 12 in a predetermined position, and an unlatched state, wherein the movable closure element 12 can be moved between the various permitted positions, such as "closed" and "open".

The system 10 further includes a first actuator assembly 20 mounted on the movable closure element 12 and having a normal state and a release state. The first actuator assembly 20 and latch assembly 16 are operatively interconnected so that the latch assembly 16 is changed from the latched state into the unlatched state as an incident of the first actuator assembly being changed from the normal state into the release state.

The details of construction of the latch assembly 16 and the part 18 on the support 14, with which it cooperates, are not critical to the present invention. The invention contemplates virtually an unlimited number of different configurations for each of the latch assembly 16 and cooperating support part 18.

Further, the precise manner in which the first actuator assembly 20 and latch assembly 16 are operatively interconnected is not critical to the present invention. The first actuator assembly 20 may be configured to interact through a direct rigid connection, a linkage, a cable, etc., all of which are well known to those skilled in the art. Exemplary latch assembly constructions are shown in U.S. Pat. No. 7,097,216 and in pending U.S. application Ser. Nos. 10/811,692, entitled "Lock System for Movable Closure Element", and 10/316,359, entitled "Latch Assembly for Movable Closure Element", the disclosures of which are incorporated herein by reference.

Figure 2:
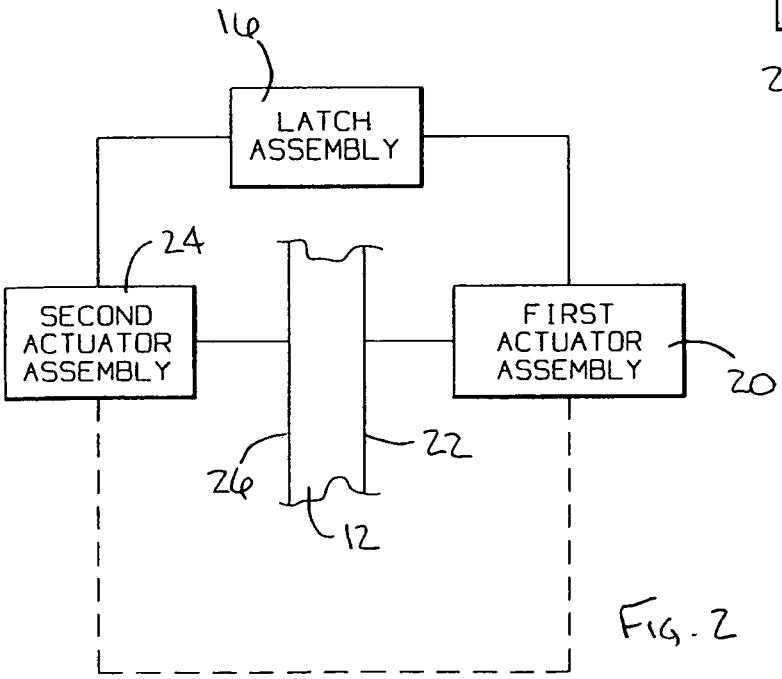
FIG. 2 is a schematic representation of a movable closure element, of the type shown in FIG. 1, and with the first actuator assembly operatively mounted on one side thereof, and a second actuator assembly operated on the opposite side of the movable closure element and designed to operatively interconnect with the latch assembly directly and/or indirectly through the first actuator assembly.

The invention contemplates that the first actuator assembly 20 can be mounted on the first side 22 of the movable closure element 12, as sown in FIG. 2. A second actuator assembly 24 can be mounted on a second side 26 of the movable closure element 12, facing oppositely to the first side 22. The second actuator assembly 24 is designed to operate the latch assembly 16, either directly or through the first actuator assembly 20, with the latter configuration indicated by dotted lines in FIG. 2.

Figure 4:
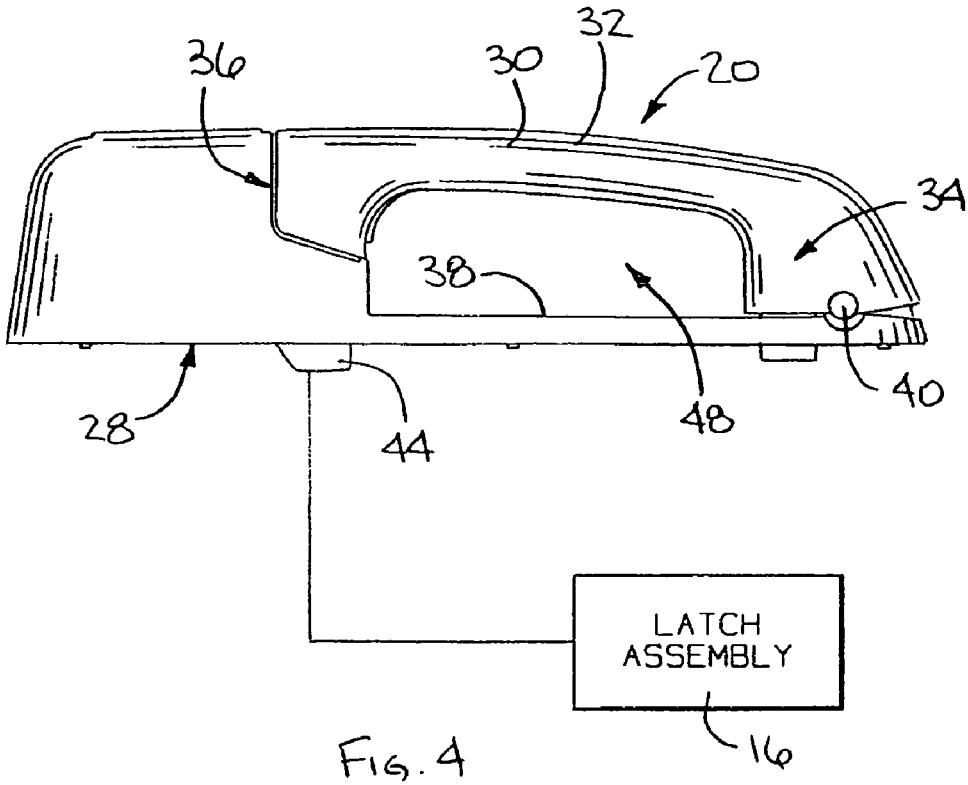
FIG. 4 is a side elevation view of the actuator assembly in FIG. 3, assembled and with a first handle thereon for changing the state of the latch assembly in a first position, corresponding to a latched state for the latch assembly.
Figure 5:
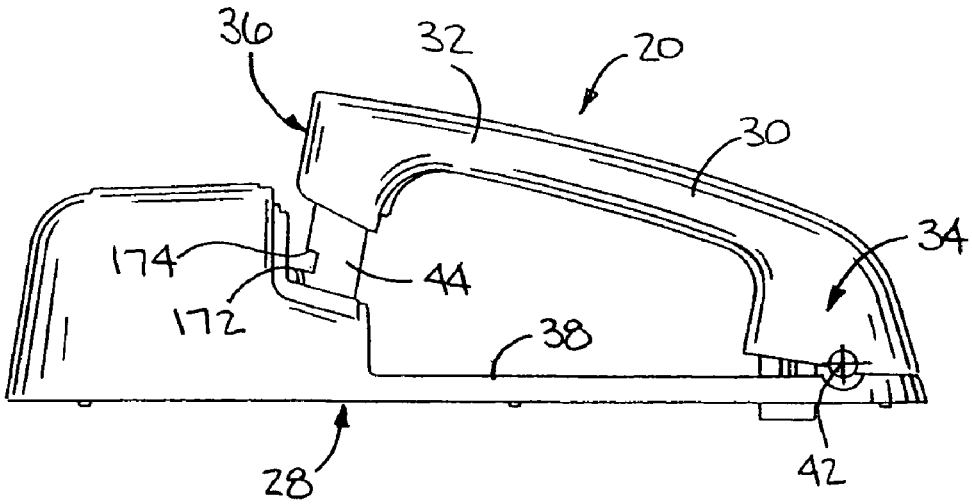
FIG. 5 is a view as in FIG. 4 wherein the first handle has been changed to a second position to thereby change the latch assembly from the latched state into an unlatched state.
Figure 6:
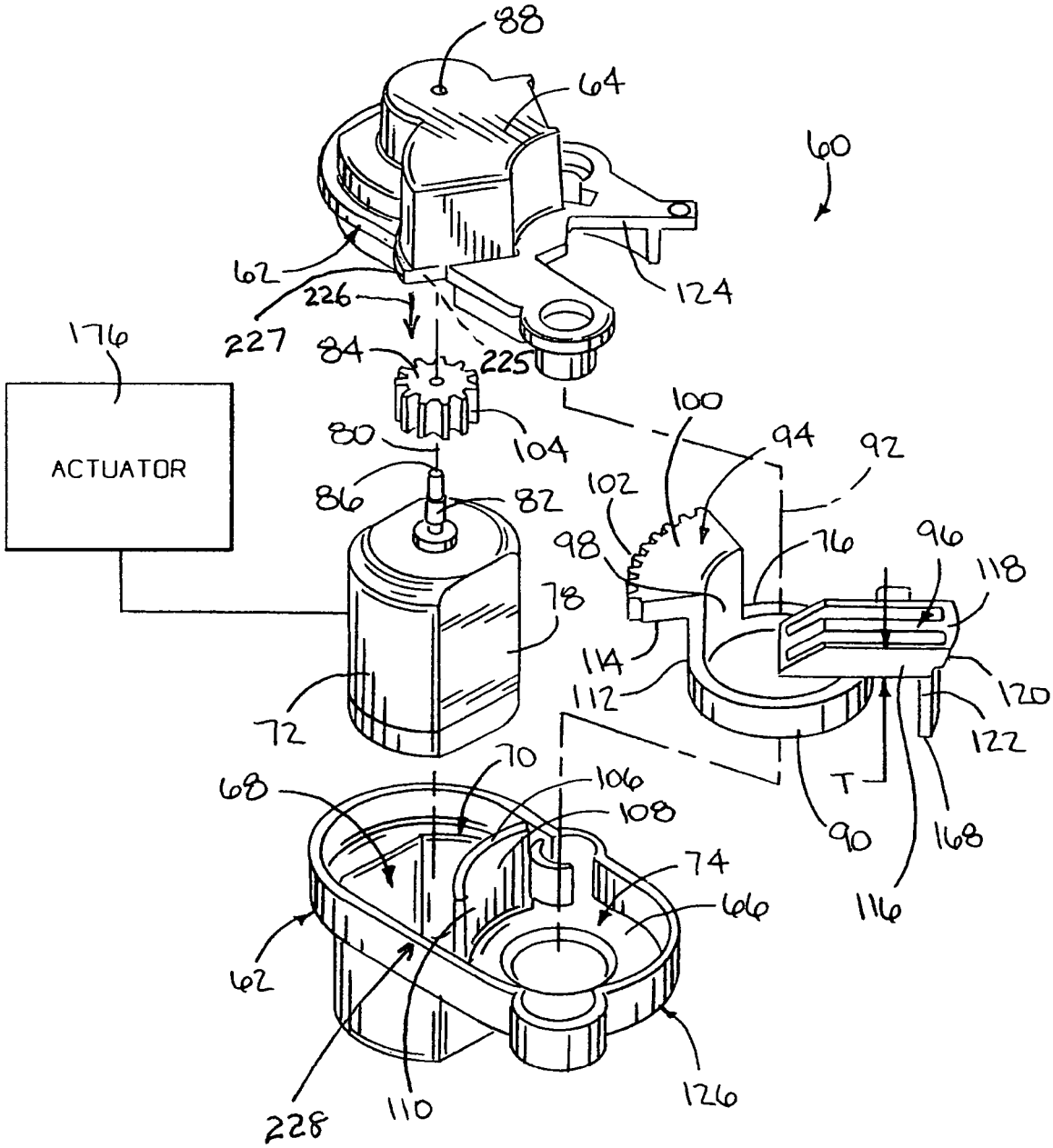
FIG. 6 is an enlarged, exploded, perspective view of a lock assembly module on the first actuator assembly and having a lock cam that cooperates with the first handle and is movable between a locked position and an unlocked position.
Figure 7:
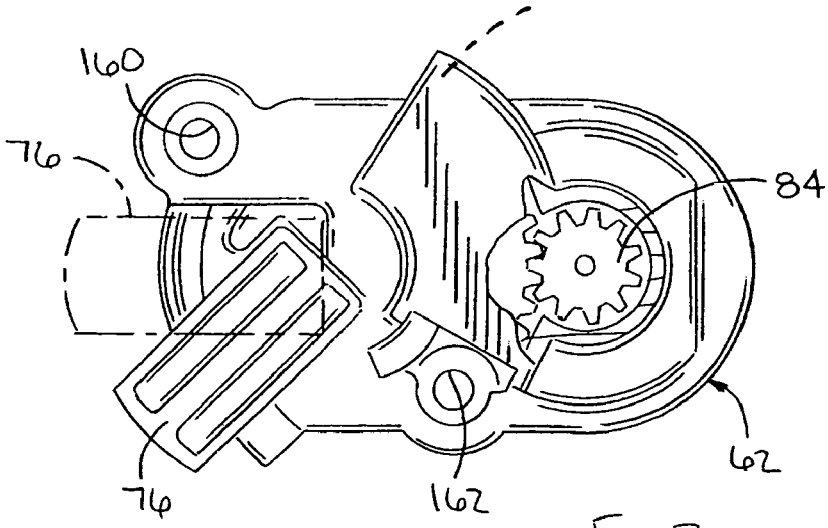
FIG. 7 is an enlarged, rear, elevation view of the assembled lock assembly module of FIG. 6 and with the lock cam in its unlocked position.
Figure 8:
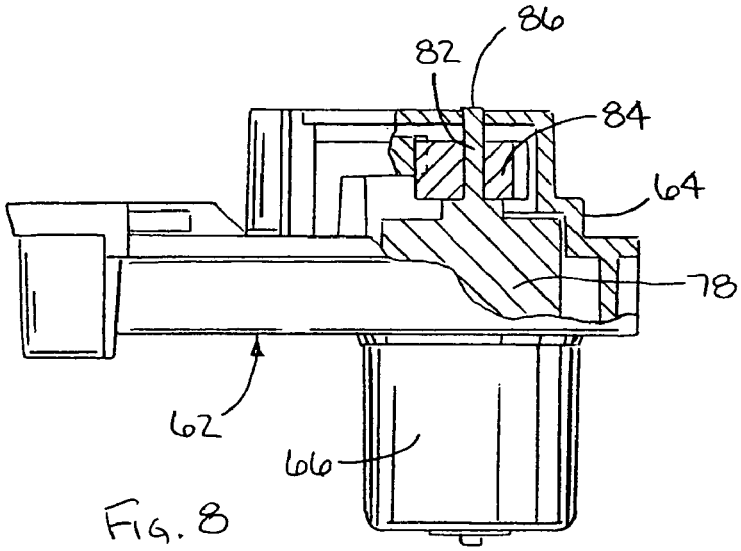
FIG. 8 is an enlarged, side, elevation view of the lock assembly module in FIGS. 6 and 7, with a housing thereon partially broken away.
Figure 9:
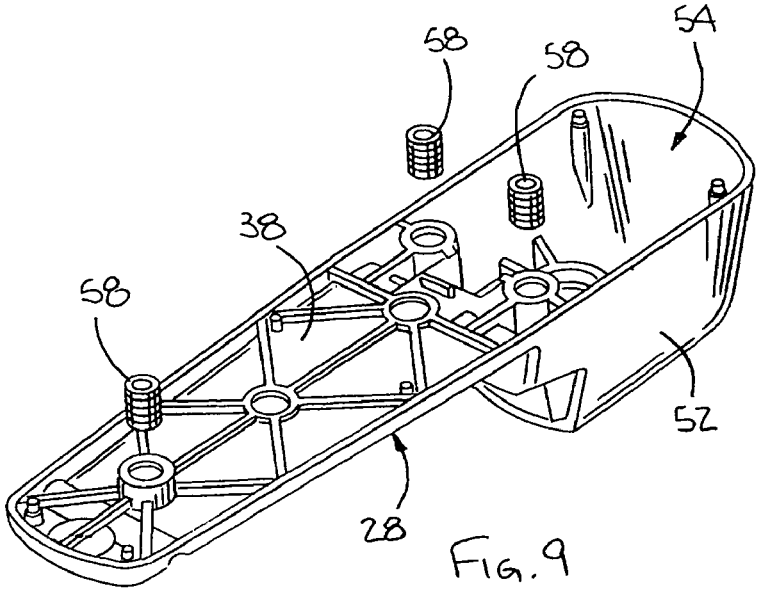
FIG. 9 is an exploded, rear, perspective view of a part of a base assembly to which the first handle is movably mounted and for receiving the lock assembly module in FIGS. 6-8.

The invention is concerned primarily with the configuration of the first actuator assembly 20. One exemplary form of the first actuator assembly 20 will now be described, with it understood that many variations thereof, within the universe of the generic showing of FIGS. 1 and 2, are contemplated. As shown in FIGS. 3-21, the exemplary first actuator assembly 20 consists of a base assembly 28 and a first handle 30 that is repositionable relative to the base assembly 28 between a first position, shown in FIG. 4, and a second position, shown in FIG. 5. The first handle 30 has a graspable, elongate body 32 and mounting and actuating ends 34, 36, respectively. A user's hand can be situated to surroundingly grasp the elongate body 32 to facilitate repositioning thereof.

The mounting end 34 is enlarged and connected to a mounting wall 38 on the base assembly 28 through a pin 40 around which the mounting end 34 of the first handle 30 is mounted for guided, pivoting movement relative to the base assembly 28 around a first axis 42. The first actuator assembly 20 is in the normal state with the first handle 30 in the first position and in the release state with the first handle 30 in the second position.

The actuating end 36 of the first handle 30 is designed to cooperate with, and change the state of, the latch assembly 16. In this embodiment, the mounting end 34 includes a cantilevered, actuating projection 44 that may directly or indirectly interact with the latch assembly 16 so that the latch assembly 16 is changed from its latched state into its unlatched state as an incident of the first actuator assembly 20 being changed from its normal state into its release state, effected in turn by movement of the first handle 30 from its first position into its second position.

The first handle 30 is normally biased into its first position by a compression coil spring 46 acting between the mounting wall 38 on the base assembly 28 and the mounting end 34 of the first handle 30. The first handle 30 is configured so that a user's fingers can be directed into a space 48 between the body 32 of the first handle 30 and the mounting wall 38, to be wrapped graspingly around the elongate body 32 to facilitate a pulling action that repositions the first handle 30 by pivoting around the axis 42.

The first handle 30 may consist of multiple components that potentially relatively move to effect actuation of the latch assembly 16. In this embodiment, the elongate body, mounting end 34, 36, and cantilevered projection 44 make up a first assembly 50 that moves by pivoting as one piece relative to the base assembly 28.

The base assembly 28 has a wall portion 52 that extends from the mounting wall 38 and bounds a cup-shaped chamber 54 for a lock assembly 56. The mounting wall 38 and wall portion 52 may be formed as one piece, as by plastic, metal, or composite. Preferably, the single piece is formed by a molding process. In the embodiment shown, metal inserts 58 are secured to the mounting wall 38 to accept fasteners (not shown) that maintain the first actuator assembly 20 operatively mounted upon the movable closure element 12 at the first side 22 thereof.

The lock assembly 56 is preferably formed as a self-contained module at 60, with components incorporated into a two-part housing 62 that, for purposes of the disclosure and the claims herein, will be considered to be part of the base assembly 28. The two-part housing 62 consists of joinable front and rear housing parts 64, 66, respectively, that cooperatively define a compartment 68 with a sub-compartment 70 that receives a motor 72 and a sub-compartment 74 within which a lock cam 76 resides and is guidingly movable. A locking element is part of the lock cam 76 and is movable with the locking cam 76 between locked and unlocked positions as the lock assembly is changed between the locked and unlocked states.

More particularly, the body 78 of the motor 72 has a nominally squared shape that seats in a correspondingly-shaped portion of the sub-compartment 70 on the rear housing part 66. Through this arrangement, the motor 72 and rear housing part 66 become keyed against relative rotation around an axis 80 about which the motor shaft 82 rotates. The shaft 82 extends fully through a toothed drive gear 84 in a manner that the free end 86 of the shaft 82 projects into an opening 88 in the front housing part 64, whereby the shaft 82 becomes journalled for rotation relative to the front housing part 64.

The lock cam 76 has a disk-shaped body 90 that nests within a portion of the sub-compartment 74 in the rear housing part 66. The disk-shaped body 90 and rear housing part 62 cooperate to guide movement of the lock cam 76 around a second axis 92 that is substantially parallel to the motor axis 80.

The lock cam 76 has generally diametrically oppositely located driven and actuating extensions 94, 96 that move as one piece with the disk-shaped body 90, and preferably are formed as one piece therewith. The lock cam 76 is movable from a locked position, as shown in dotted lines in FIG. 7, and an unlocked position, as shown in solid lines in that same Figure. With the lock cam 76 in the locked position, the lock assembly 56 is in a locked state. With the lock cam 76 in the unlocked position, the lock assembly is in an unlocked state. As explained in greater detail below, with the lock assembly 56 in its locked state, the actuating extension 96 directly engages and blocks movement of the actuating projection 44, and thereby the first assembly 50, as would otherwise allow the first handle 30 to be changed from its first position into its second position, thereby in turn causing the first actuator assembly 20 to be changed from its normal state into its release state.

The driven extension 94 consists of an curved segment 98 that projects axially rearwardly from the body 90 and has an outturned, arcuate wall segment 100 with teeth 102 thereon that are in mesh with teeth 104 on the drive gear 84. With the body 90 nested in the sub-compartment 74, the curved segment 98 has a sufficient axial extent that the segment 100 can project across the top 106 of a curved wall 108 to allow the teeth 102, 104 to be placed in mesh. The wall 108 resides between the sub-compartments 70, 74 and has a curved wall surface 110 that guides the convexly, complementarily-curved surface 112 on the segment 98, thereby to reinforce and guide the lock cam 76 in its movement around the axis 92 between locked and unlocked positions. The top 106 of the wall 108 resides beneath the axially forwardly facing surface 114 on the segment 100, to engage the lock cam 76 so as to thereby maintain alignment of the lock cam 76 in a manner that the teeth 102, 104, respectively on the lock cam 76 and drive gear 84, consistently and properly mesh.

The actuating extension 96 consists of a cantilevered arm 116 projecting away from the body 90. The arm 116 has an axial thickness T that is substantially uniform over the length of the arm 116. The arm 116 has an axially facing blocking surface 118 that terminates at an angled free end 120. A leg 122 projects axially from adjacent the free end 120 of the arm 116. The leg 122 extends generally orthogonally to the length of the arm 116.

With the lock cam 76 assembled, the arm 116 extends through a cut-out 124 in the housing 62 and projects to beyond an end 126 thereof for interaction with the actuating projection 44, as hereinafter described. The cut-out 124 is configured so that an edge 128 bounding the cut-out 124 has a generally "M" shape, defined by longer edge portions 130, 132 and shorter edge portions 134, 136.

The lock cam 76 is consistently blocked in its locked and unlocked positions by reason of the interaction of the peripheral edge 138 of the arm 116 with the housing edge at 128. More particularly, the peripheral edge 138 has a substantially rectangular shape with longer edge portions 140, 142 and shorter edge portions 144, 146, with the shorter edge portion 146 at the free end 120. As seen in FIGS. 10-14, as the lock cam 76 moves from the unlocked position into the locked position therefor, the edge portions 142, 144 on the lock cam 76 nest against the housing edges 130, 134, respectively. As the lock cam 76 is moved from the locked position into the unlocked position therefor, the edge portions 140, 144 on the lock cam 76 nest against the housing surfaces 132, 136, respectively.

To releasably maintain the lock cam 76 in the unlocked position therefor, as to prevent inadvertent shifting to a locked position, potentially under the influence of forces encountered during use, a detent arrangement is provided at 148. The detent arrangement 148 includes cooperating detent components 150, 152 on the housing 62 and lock cam 76, respectively. The detent component 150 is in the form of a dimple on a discrete tab 154 projecting from the housing 62. The detent component 152 consists of a rounded projection on a tab 156 projecting from the arm 116. As the lock cam 76 is moved towards the unlocked position therefor, the projection 152 encounters the tab 154 and thereby deforms and/or is deformed by the tab 154 to allow the projection 152 to move into the dimple 150 and is therein releasably maintained to inhibit movement of the lock cam 76, as might otherwise occur when an impact occurs or the system is subjected to ongoing vibration and/or rattle. The operating force of the motor 72 is adequate to overcome the releasable holding force that is produced between the detent components 150, 152, when it is desired to place the lock cam 76 in the locked position therefor.

With the motor 72 and lock cam 76 preassembled to the rear housing part 66, the assembly of the front housing part 64 to the rear housing part 66 causes the motor 72 and lock cam 76 to be captively maintained in an operative position to thereby produce the aforementioned, self-contained module 60. The module 60 can be directed from rear to front as a unit into an assembled state within the chamber 54 and secured to the wall portion 52 by suitable fasteners 158, directed through housing openings 160, 162. The wall portion 52 has pre-threaded bores 164, 166 to each receive a fastener 158 directed through the bores 160, 162, respectively. With the module 60 assembled, the free end 168 of the leg 122 on the lock cam 76 resides in close proximity to a rearwardly facing surface 170 on the wall portion 52.

The actuating projection 44 on the first handle 30 projects into the chamber 54 within which the module 60 is placed and resides in the path of the cantilevered arm 116 on the lock cam 76 thereby to directly engage the first assembly 50. To cooperate with the lock cam 76, the actuating projection 44 has a U-shaped receptacle 172 formed therein opening away from the first axis 42. The receptacle 172 is bound by a rearwardly facing shoulder 174. With the first handle 30 in its first position, shown in FIG. 4, actuation of the motor 72 in one rotational direction causes the lock cam 76 to be moved from its unlocked position of FIG. 12 into its locked position of FIG. 14. As this occurs, the free end 120 of the arm 116 moves into the receptacle 172 so that the blocking surface 118 on the lock cam arm 116 confronts the rearwardly facing shoulder 174 bounding the receptacle 172. The first handle 30 is thus directly engaged by the lock cam 76 and blocked from movement between its first position of FIG. 4 and second position of FIG. 5.

Figure 14:
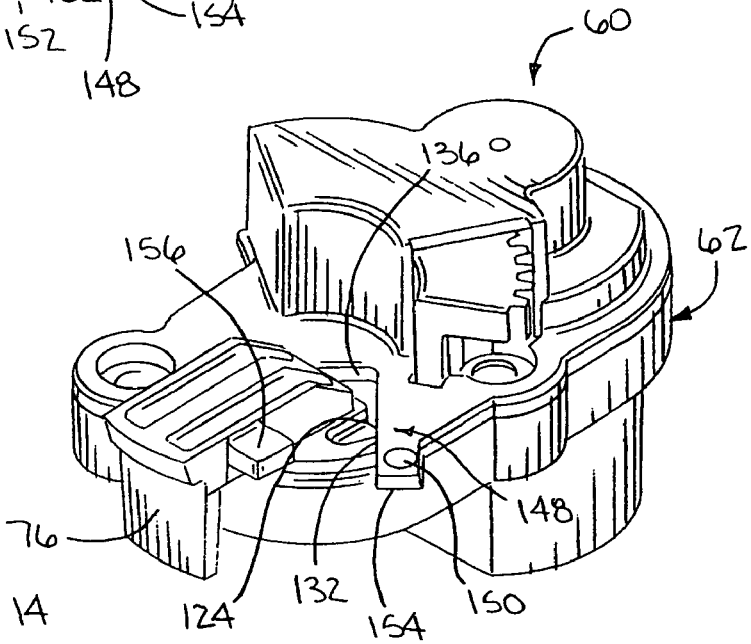
FIG. 14 is a view as in FIGS. 12 and 13 with the lock cam fully in its locked position.
Figure 15:
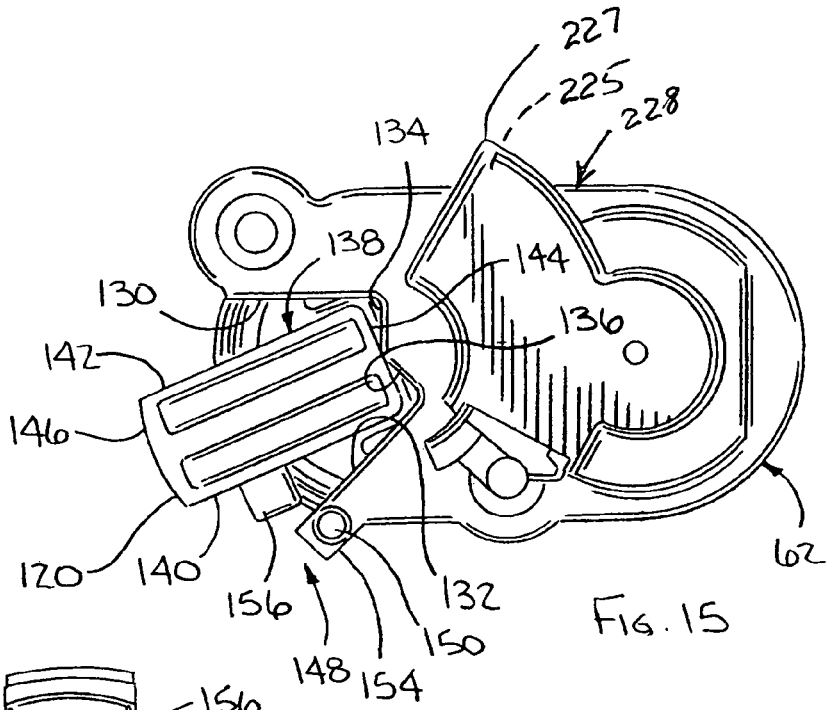
FIG. 15 is an enlarged, rear, elevation view of the lock assembly module with the lock cam in the FIG. 13 position.
Figure 16:
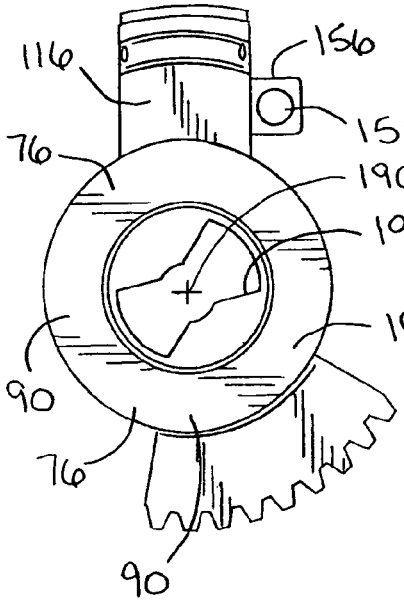
FIG. 16 is an enlarged, front, elevation view of the lock cam.
Figure 17:
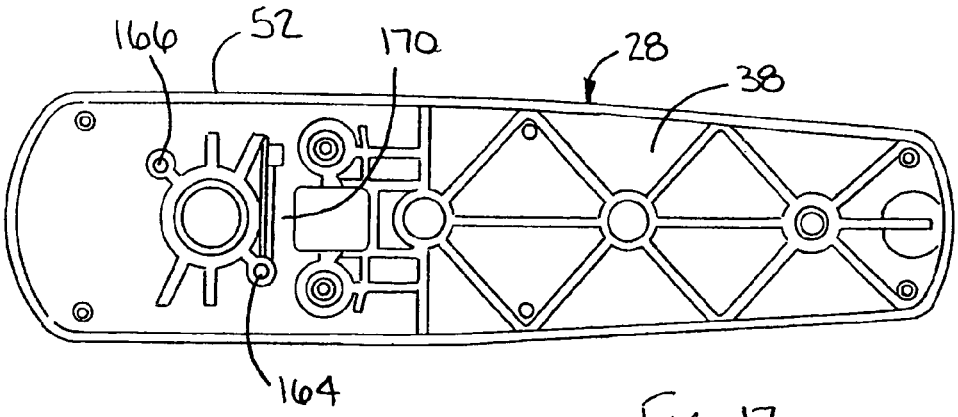
FIG. 17 is a rear elevation view of the base assembly on the first actuator assembly with the lock assembly module removed.
Figure 18:
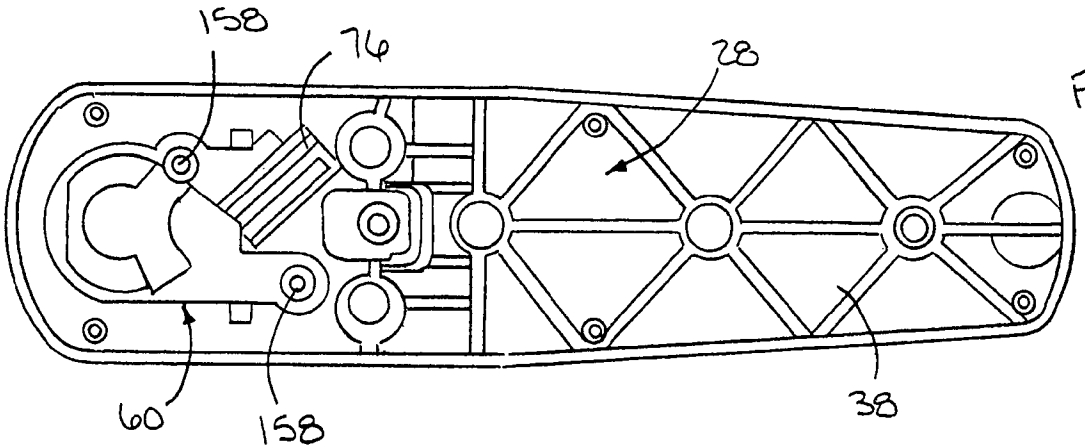
FIG. 18 is a view corresponding to that in FIG. 17 with the lock assembly module installed.
Figure 21:
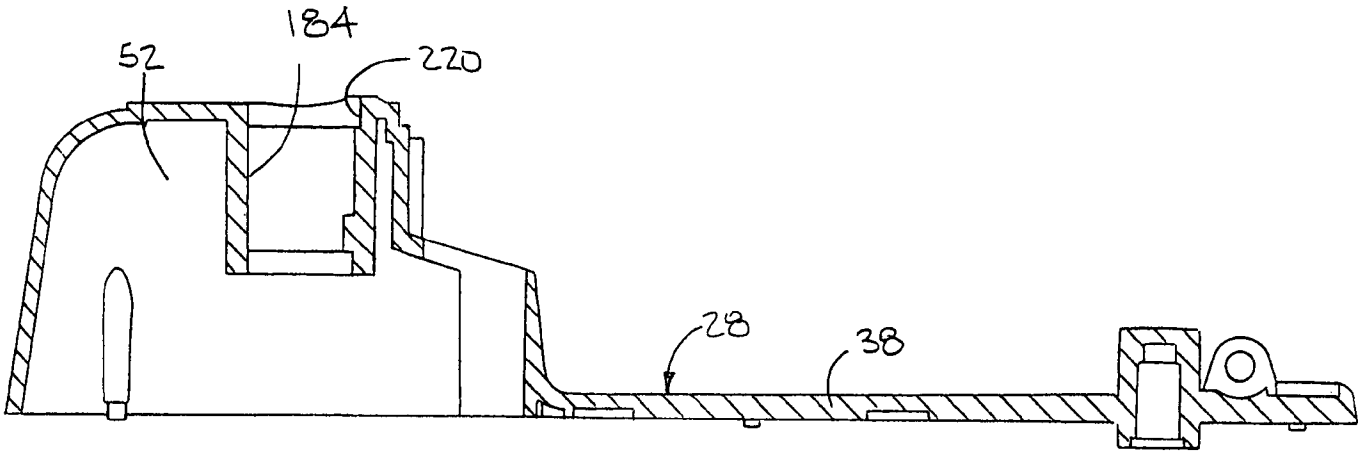
FIG. 21 is an enlarged, cross-sectional view of the base assembly showing a wall surface that cooperates with the lock assembly module in FIGS. 19 and 20.

The interaction of the free end 168 with the surface 170 prevents bending of the lock cam arm 116 as a result of a forced entry load with the lock cam arm 116 within the receptacle 172 wherein the lock cam 76 is in its locked position of FIG. 14. The leg 122 also prevents rotation of the lock cam 76 with an opening pulling force applied to the first handle 30.

The motor 72 may be any type of motor that is actuatable selectively in opposite directions through an actuator 176. The actuator 176 can take virtually an unlimited number of different forms. The actuator 176 may be hard wire connected for operation of the motor 72, or may be capable of producing a signal wirelessly to the motor 72 to effect operation thereof. As the motor 72 is operated, the drive gear 84 positively imparts movement to the lock cam 76 through the toothed wall segment 100.

Figure 3:
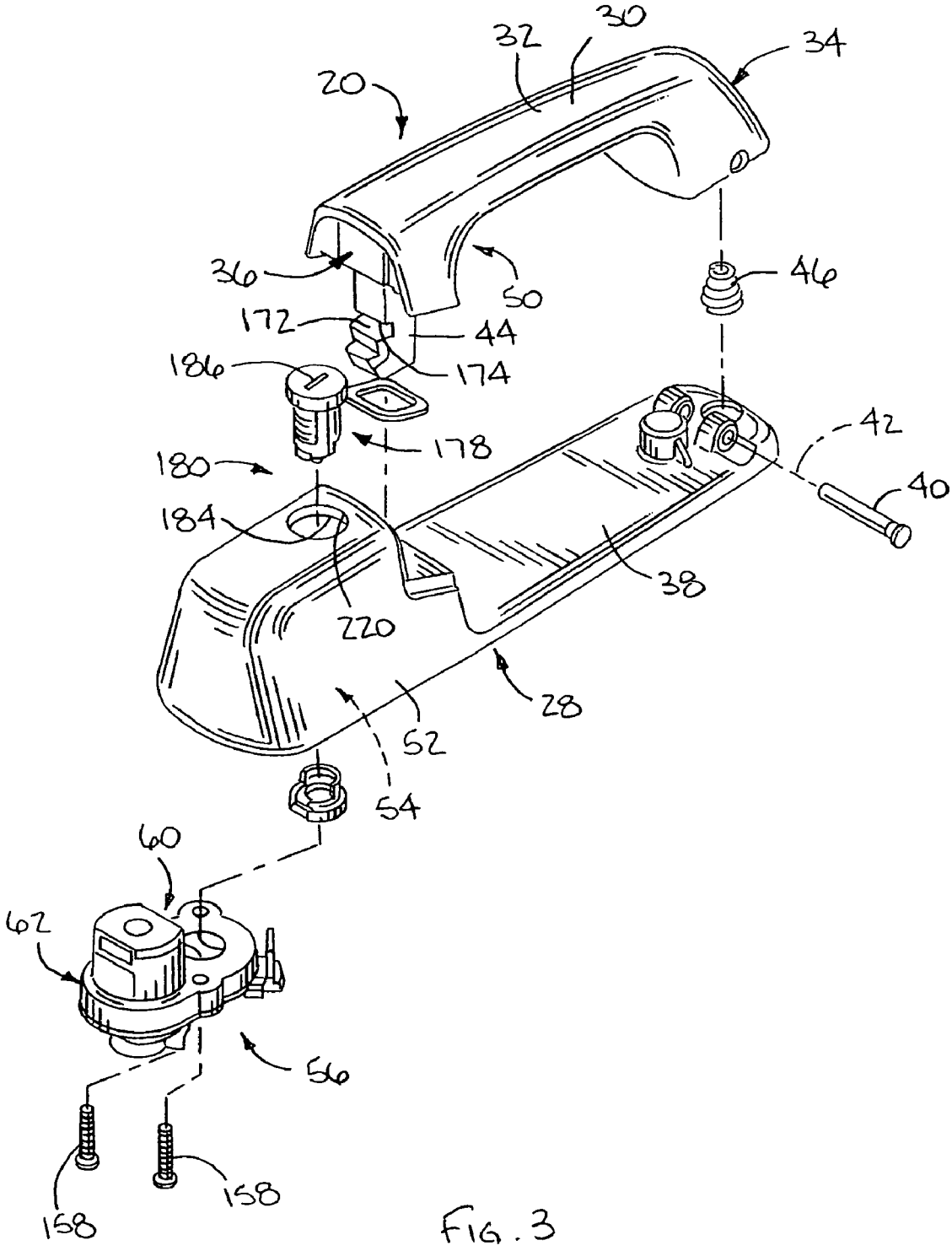
FIG. 3 is an exploded, perspective view of one form of a first actuator assembly, shown schematically in FIGS. 1 and 2.
Figure 19:
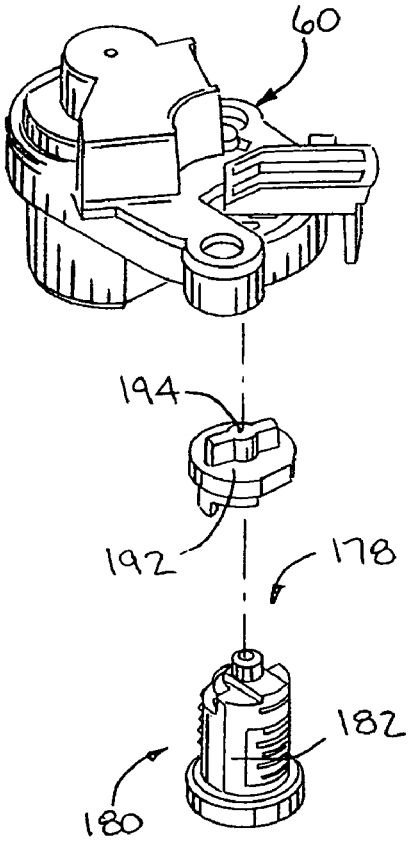
FIG. 19 is an enlarged, exploded, rear, perspective view of the manual actuator subassembly with the actuating projection in relationship to the remainder of the lock assembly module.
Figure 20:
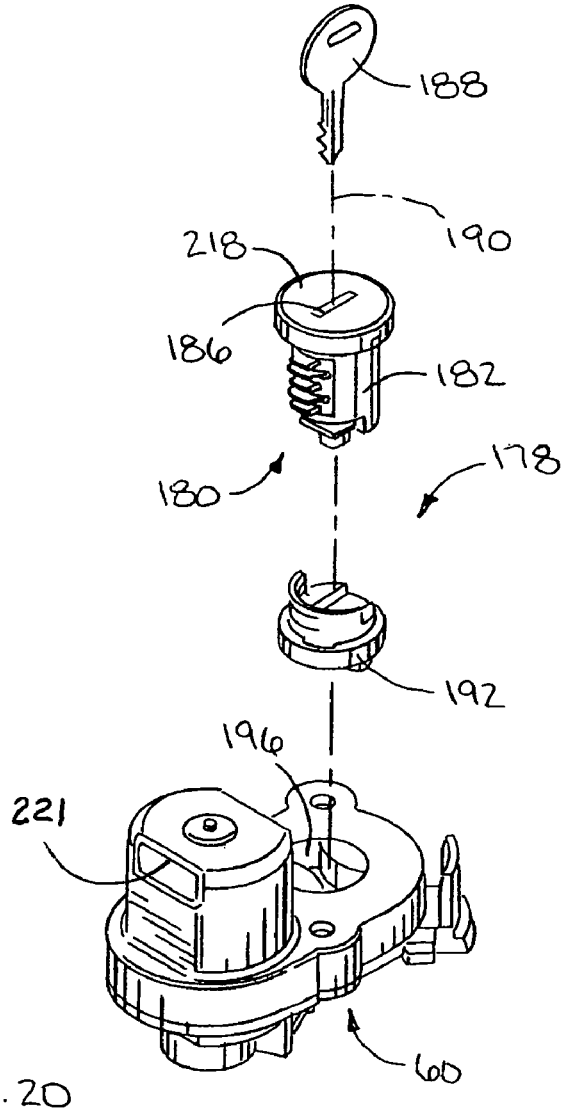
FIG. 20 is an exploded, perspective view of the components in FIG. 19 from a front vantage point.

The lock assembly 56 further includes a manual actuator subassembly 178 as seen most clearly in FIGS. 3, 19 and 20. The manual actuator subassembly 178 includes a lock plug at 180 consisting of a cylinder 182 that is accepted in a housing 184, shown in this case in FIG. 21 to be defined by the base assembly 28. The housing could be defined separately so it can be preassembled with the cylinder 182 preparatory to installation upon the base assembly 28.

The cylinder 182 has a keyway 186 for an access key 188 through which the cylinder 182 can be rotated around a central axis 190 for the cylinder 182 between locking and unlocking positions. The actuator subassembly 178 further includes an actuating component 192 with an actuating projection 194.

With the manual actuator subassembly 178 assembled to the base assembly 28, the actuating projection 194 extends into a butterfly-shaped slot 196 in the front side 198 of the disk-shaped body 90 of the lock cam 76. The actuating projection 194 and slot 196 on the lock cam 76 are configured to define a lost motion connection whereby an operator has the ability to independently and selectively either: a) manually operate the lock cam 76 through the manual actuator subassembly 178; or b) operate the lock cam 76 through the motor 72.

Figure 10:
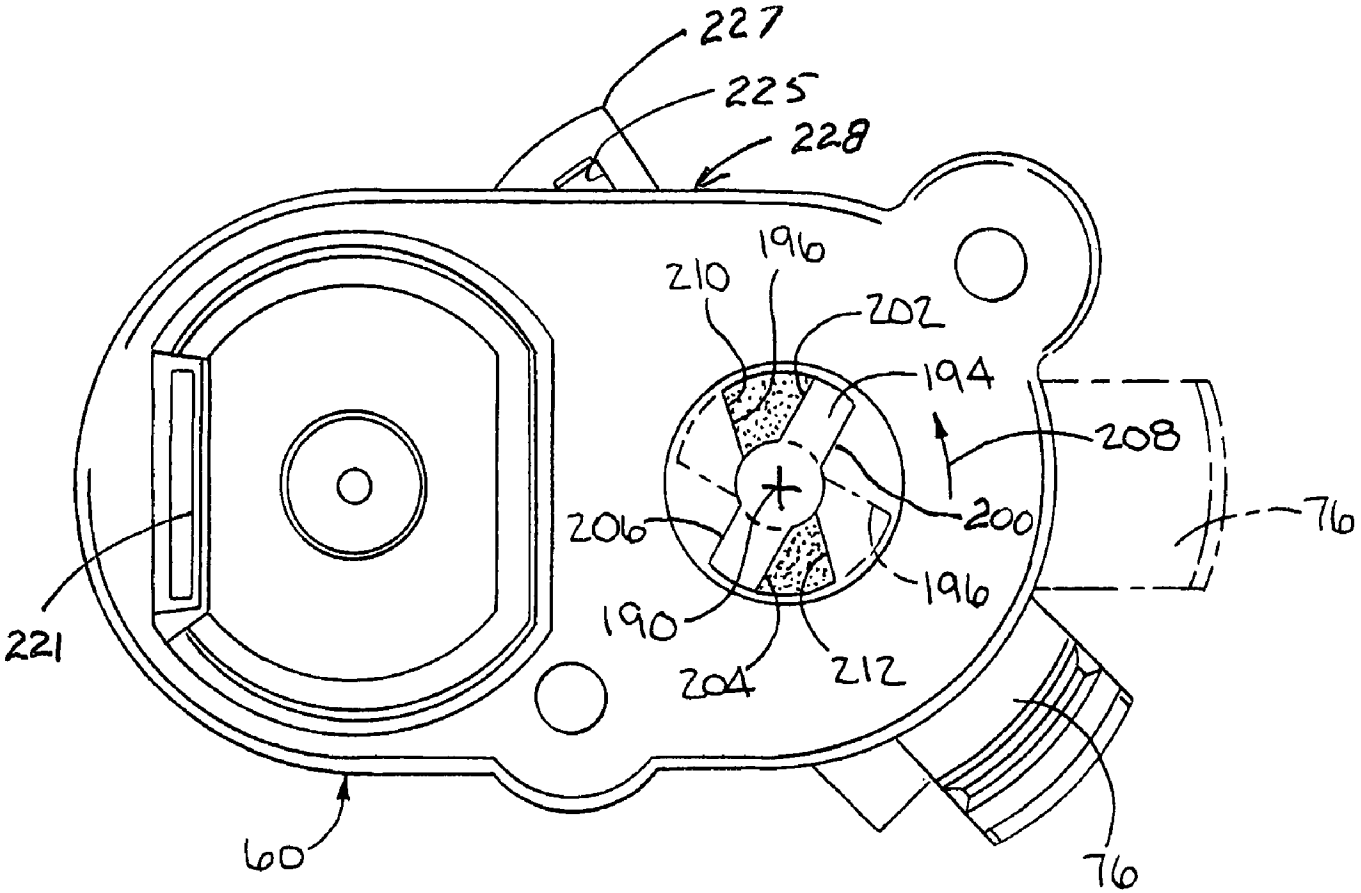
FIG. 10 is an enlarged, front, elevation view of the lock assembly module in FIGS. 6-8 and showing the cooperation between the lock cam and an actuating projection on a manual actuator subassembly.

In FIG. 10, the lock cam 76 and slot 196 therein are shown in dotted lines with the lock cam 76 in the locked position and in solid lines in the unlocked position therefor. The actuating projection 194 has a generally rectangular shape with flat, oppositely facing actuating surfaces 200, 202 on one side of the axis 190, and oppositely facing actuating surfaces 204, 206 on the opposite side of the axis 190. The actuating projection 194 is in the unlocking position in FIG. 10. For clarity purposes, the slot portion unoccupied by the actuating projection 194 with the lock cam 76 in the unlocked position is shaded in FIG. 10.

With the lock cam 76 in the unlocked position therefor in FIG. 10, the actuating projection 194 can be pivoted from its unlocking position about the axis 190 through the access key 188. More particularly, the actuating projection 194 can be changed from its unlocking position, by turning the access key 188 and thus the actuating projection 194 around the axis 190 in the direction of the arrow 208. The actuating projection 194 moves within the slot 196, initially without moving the lock cam 76, until the actuating projection surfaces 202, 204 simultaneously, respectively bear upon slot surfaces 210, 212. Continued movement of the lock cam 76 through the access key 188 causes the actuating projection 194 to drive the lock cam 76 to the locked position, as shown in solid lines in FIG. 11, wherein the actuating projection 194 is shown in the locking position. Again, for clarity purposes, the slot portion unoccupied by the actuating projection 194 with the lock cam 76 in the locked position is shaded in FIG. 11.

Figure 11:
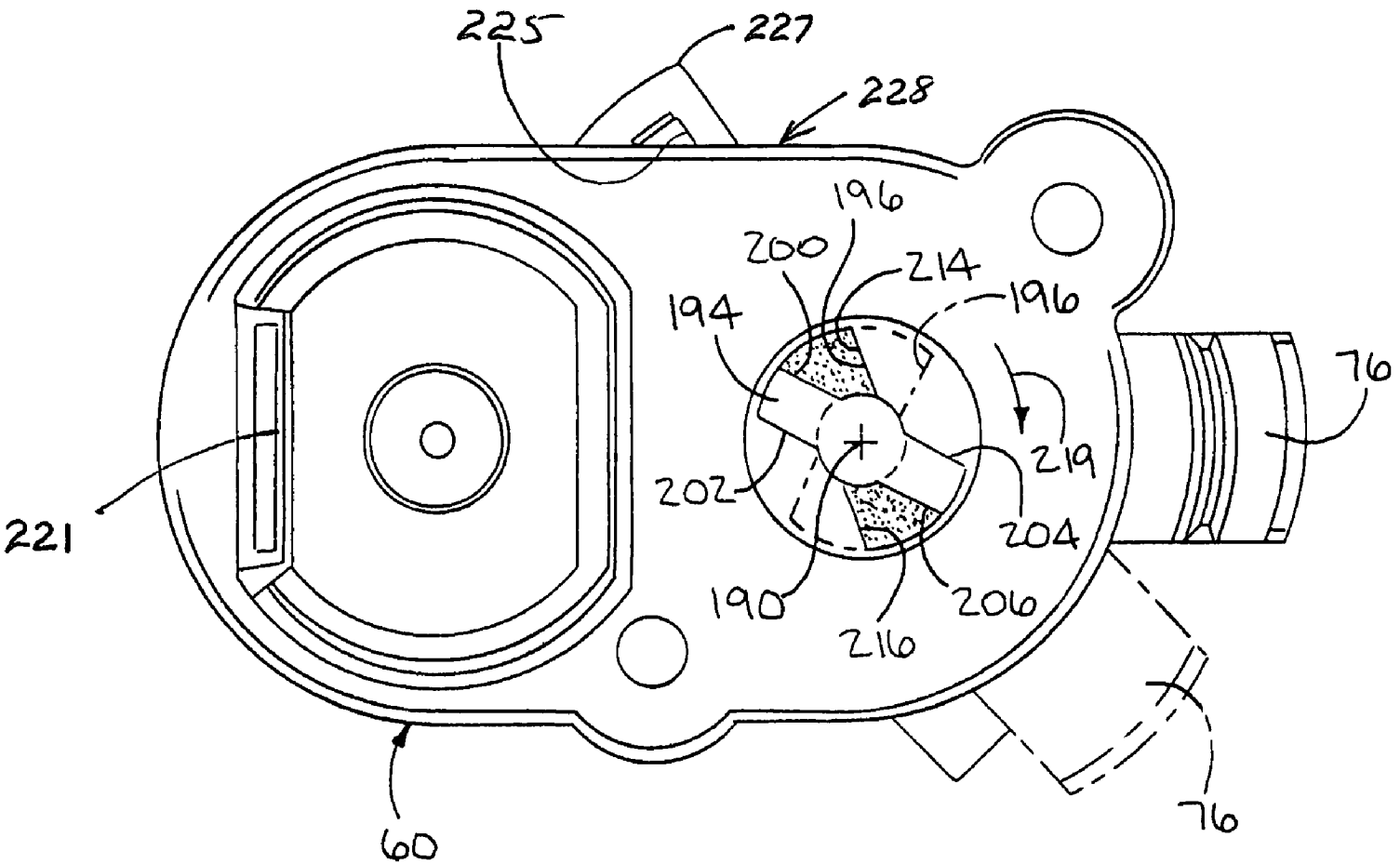
FIG. 11 is a view as in FIG. 10 and showing a different relationship between the actuating projection and lock cam.

With the lock cam 76 in the locked position, and the actuating projection 194 in the locking position, as seen in FIG. 11, the actuating projection 194 can be moved oppositely to the locking direction, as indicated by the arrow 219 in FIG. 11, around the axis 190. The actuating projection 194 moves from its locking position towards its unlocking position within the slot 196, initially without moving the lock cam 76, until the actuating projection surfaces 200, 206 bear simultaneously and respectively against the slot surfaces 214, 216, thereby to pivot the cam lock 76 from the locked position to the unlocked position, as shown respectively in FIGS. 11 and 10 in solid lines.

Because of the configuration of the slot 196, and the lag/lost motion permitted thereby between the actuating projection 194 and lock cam 76, with the actuating projection 194 situated in the unlocking position of FIG. 10, the lock cam 76 can be driven by the motor 72 to be changed from the unlocked position, to the locked position, in the direction of the arrow 208, without any interference between the actuating projection 194 and lock cam 76 within the lost motion/lag range, as determined by the configuration of the slot 196.

Similarly, with the lock cam 76 in the locked position of FIG. 11, and the actuating projection 194 in its locking position, the lock cam 76 can be driven by the motor 72 to the unlocked position without any interference between the actuating projection 194 and lock cam 76 within the lag range. Accordingly, the motor 72 can be actuated to change the state of the lock assembly 56 without any interference with the manual actuator subassembly 178.

The manual actuator subassembly 178 can be either preassembled to be part of the aforementioned self-contained module 60 or, alternatively, can be assembled as a separate component. In the former case, the manual actuator subassembly 178 is attached to the housing 62 and translated in a rear to front assembly step, whereupon the front 218 of the cylinder 182 passes through an opening 220 in the wall portion 52 to be exposed at the front of the base assembly 28. Assembly in this manner is only practical if the manual actuator subassembly 178 is self-contained with a cylinder housing (not shown), corresponding to that 184 on the base assembly 28.

In the embodiment shown, with the base assembly 28 defining the housing 184, the manual actuator subassembly 178 must be directed in a front to rear direction through the opening 220 into operative relationship with the module 60, wherein the actuating projection 194 seats within the slot 196 for operation, as described above.

The compartment 68, in certain environments, may be prone to accumulating moisture that may migrate thereinto. To avoid any detrimental residence of water within the compartment 68, weep openings are strategically located. A housing weep opening 221 is provided at an edge in the rear housing part 66 to allow forward and transverse discharge of moisture from within the compartment 68. A housing weep opening 222 (FIG. 12) facilitates drainage gravitationally primarily with the first actuator assembly 20 situated so that the length of the graspable body 32 is oriented substantially vertically. With the length of the graspable elongate body 32 horizontally oriented, a separate weep opening 224 (FIG. 13) is provided in the housing 62. On the side of the housing 62, opposite where the weep opening 224 is formed, a separate weep opening 225, as seen in FIGS. 6, 10, 11 and 15, is formed to permit egress of moisture rearwardly in the direction of the arrow 226 in FIG. 6. As seen in these Figures, a portion of the rear housing part 64 has a triangular projection 227 beyond a straight length of a rim at 228 on the rear housing part 66 where the housing parts 64, 66 are joined. This mismatching of shapes creates the weep opening 225 that is in communication with the compartment 68.

Figure 22:
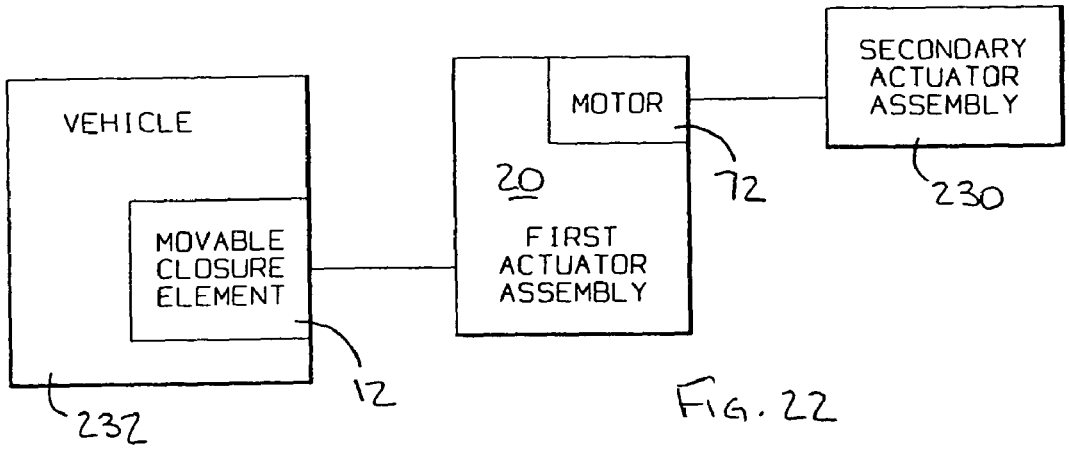
FIG. 22 is a schematic representation of the inventive system, as previously described, including a second actuator assembly for operating the motor in response to certain encountered conditions.

As shown in FIG. 22, a secondary actuator assembly 230 may be provided to cause actuation of the motor 72 in response to conditions that may result/be experienced with the movable closure element 12 associated with a vehicle 232 that may be a recreational vehicle, an automobile, an off-road vehicle, a piece of agricultural equipment, etc. The secondary actuator assembly 230 is designed to either maintain the state of the lock assembly on the first actuator assembly 20 or change the state of the lock assembly as a particular condition dictates. For example, in the event of a vehicle impact, an external force may be produced, as an incident of which the secondary actuator assembly 230 causes the motor 72 to change the lock assembly into its locked state. In the event that the closure element 12 is in a partially closed state, it may be desirable to cause the secondary actuator assembly 230 to actuate the motor 72 to place the lock assembly in its locked state. Alternatively, with the vehicle 232 not inhabited and the closure element ajar, it may be desirable to preclude actuation of the motor 72 to change the lock assembly to a locked state, thereby requiring the user to fully close the closure element 12. Likewise, with the closure element 12 in an open state, it may be desirable not to have the ability to change the lock assembly into a locked state. In the event of a malfunction of some component of the vehicle 232, such as its engine, it may be desirable to automatically change the lock assembly into an unlocked state through the secondary actuator assembly 230. Automatic changing of the lock assembly to an unlocked state may be desirable in the event that there is a fire and excessive heat or smoke are detected. In agricultural equipment, it may be desirable to preclude the opening of the closure element 12 when there is a dangerous obstruction in the vicinity of the closure element 12. The secondary actuator assembly 230 may thus prevent operation of the motor 72 as might change the lock assembly to the unlocked state. These are but a few of the conditions that are contemplated by the invention where it would be warranted to either maintain the state of the lock assembly or change its state automatically in response to this condition being detected/encountered.

The secondary actuator assembly 230 may be hard wire connected or may operate through transmitted signals from an appropriate control associated with the secondary actuator assembly 230. The assignee herein currently offers wireless technology suitable for this use that it identifies as its "e-ASK and e-FOB" systems. These systems are described in each of U.S. Pat. Nos. 6,789,003 and 7,034,655, commonly owned herewith. The disclosure in each of these patents is incorporated herein by reference.

Figure 23:
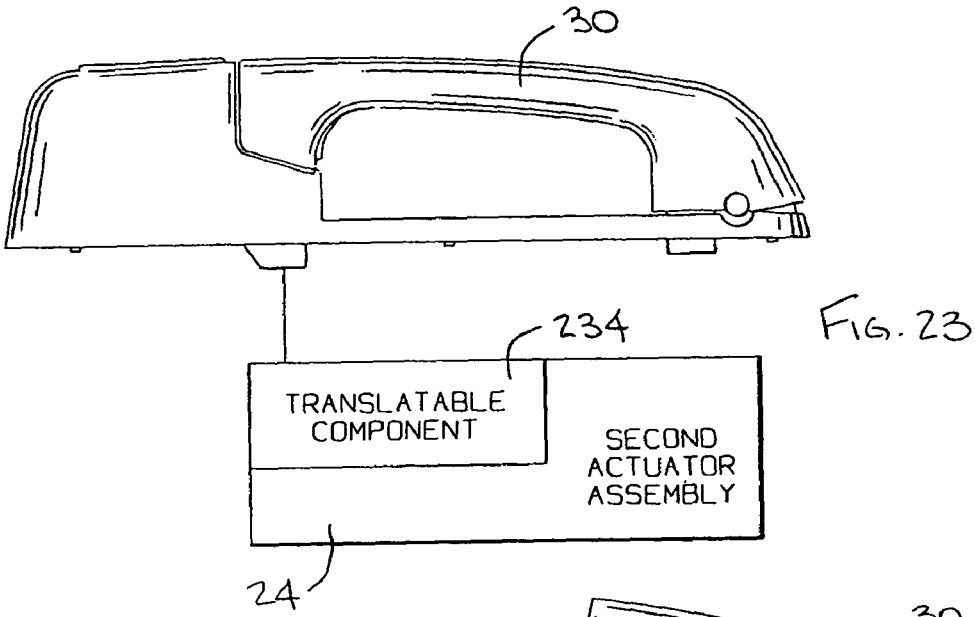
FIG. 23 is a view as in FIG. 4 wherein one type of second actuator assembly, as shown in FIG. 22, with a translatable component, is shown and with the first handle in the first position therefor.
Figure 24:
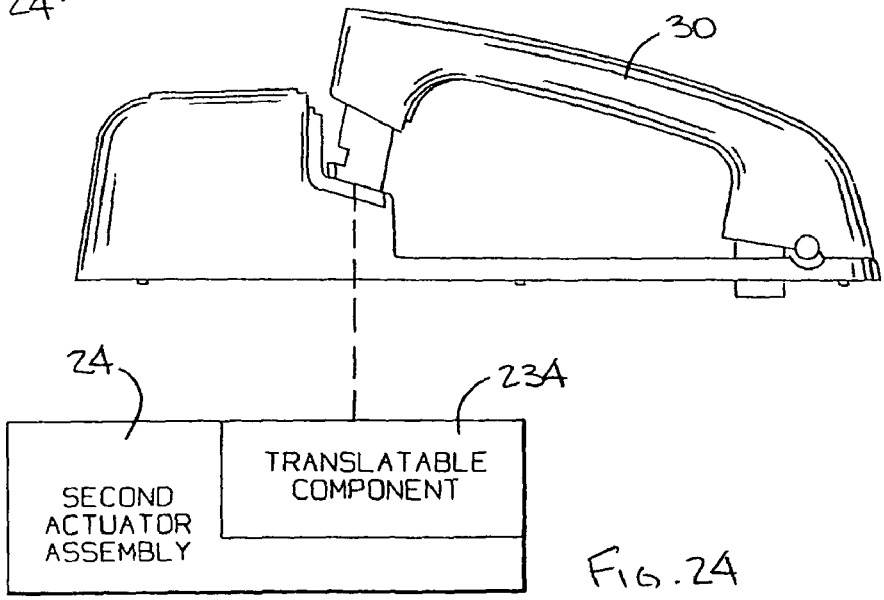
FIG. 24 is a view as in FIG. 23 with the first handle in its second position.

The second actuator assembly 24, shown in FIG. 2, can take virtually an unlimited number of different forms. With the construction of the first actuator assembly 20 as described above, the cantilevered projection 44 is moved substantially in a straight line as the first handle 30 is changed between its first and second positions. Accordingly, as shown in FIGS. 23 and 24, the second actuator assembly 24 may be in the form of a push button arrangement wherein there is a translatable component 234 that is repositioned from the second side 26 of the closure element 12, to thereby change the first handle 30 from the first position of FIG. 23 into the second position of FIG. 24. As noted previously, other configurations for the second actuator assembly 24 are contemplated and may be virtually limitless in their variations so as to allow changing between the normal and release states, as for the first actuator assembly 20.

Many variations of the system 10, described above, are contemplated. As just one example, while the motor 72 and lock cam 76 cooperate through meshing teeth on gears/gear parts, other types of drive elements are contemplated. For example, a friction drive could be utilized in place of that shown.

Figure 25:
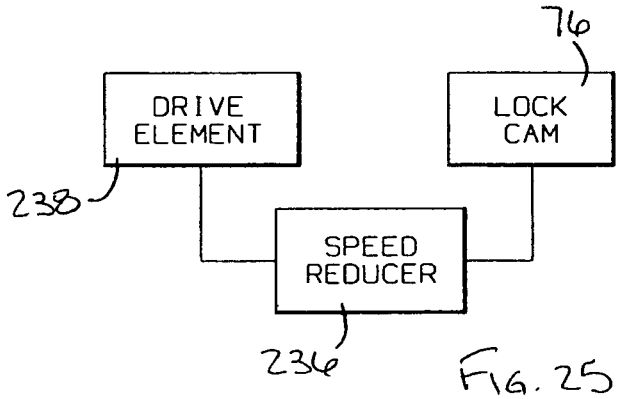
FIG. 25 is a schematic representation showing the cooperation between the motor and lock cam with an intermediate speed reduction gear.

As another variation, rather than directly driving the lock cam 76 through a drive element on the motor shaft 82, a speed reducer 236, as shown in FIG. 25, can act between the drive element 238 and lock cam 76.

Preferably, the lock cylinder 182 functions so that the access key 188 can be withdrawn with the actuating projection 194 in each of the locking and unlocking positions therefor. The basic key cylinder technology is well known and structure appropriate to accomplish this is well known to those skilled in the art. An exemplary form thereof is shown in U.S. Pat. No. 5,606,882. The configuration of the slot 196, with the lost motion configuration, facilitates this key removal feature.

The actuator 176 may likewise take virtually an unlimited number of different forms. As just examples, locking and unlocking by operation of the motor 72 can be effected through an actuator 176 that is in the form of a switch, a remote radio frequency generator, a keypad, etc.

Figure 12:
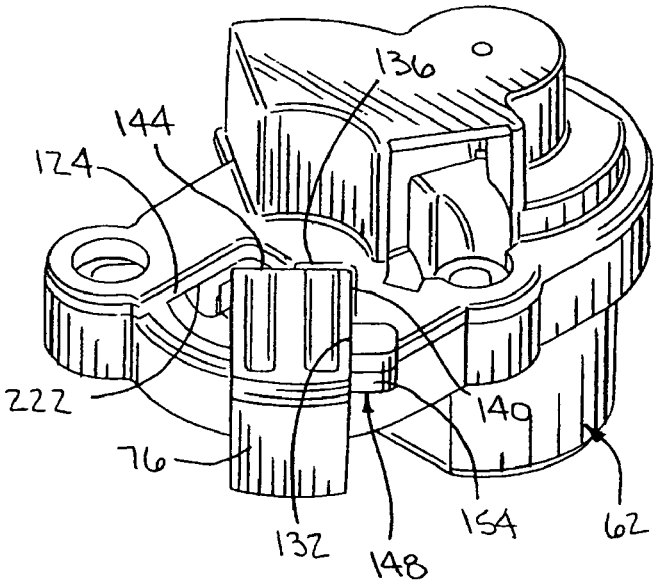
FIG. 12 is an enlarged, rear, perspective view of the lock assembly module with the lock cam in an unlocked position and a detent feature engaged.
Figure 13:
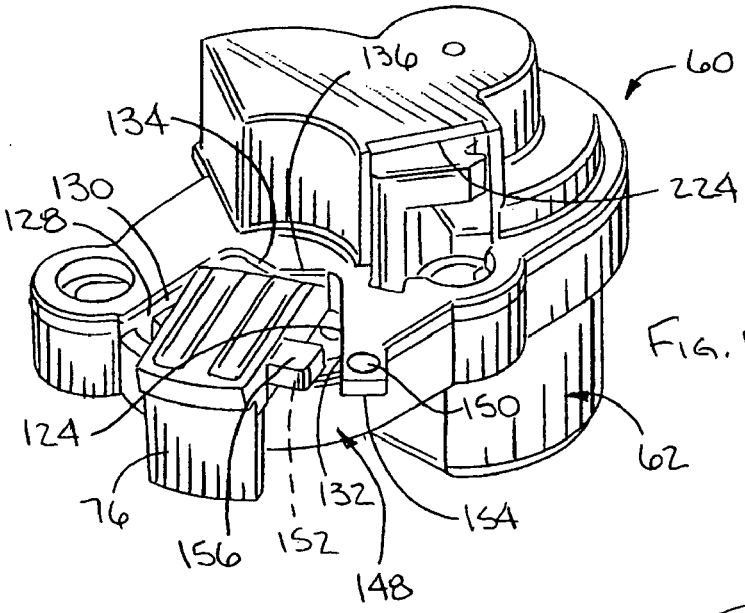
FIG. 13 is a view as in FIG. 12 with the lock cam moved towards its locked position.
Figure 26:
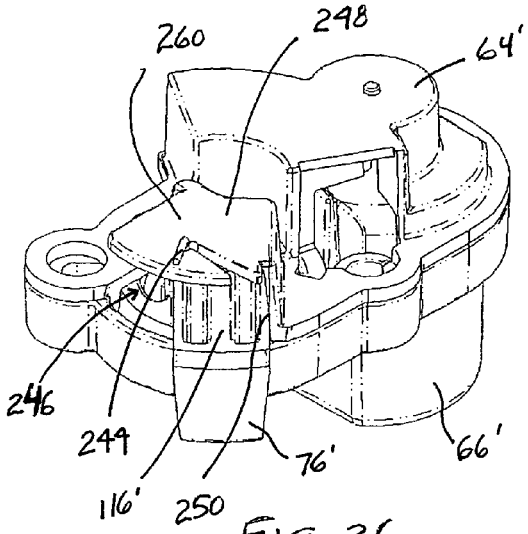
FIG. 26 is a view as in FIG. 12 and showing a detent arrangement that is modified from that in FIG. 12 and uses a torsion spring and with the lock cam in its unlocked position.
Figure 27:
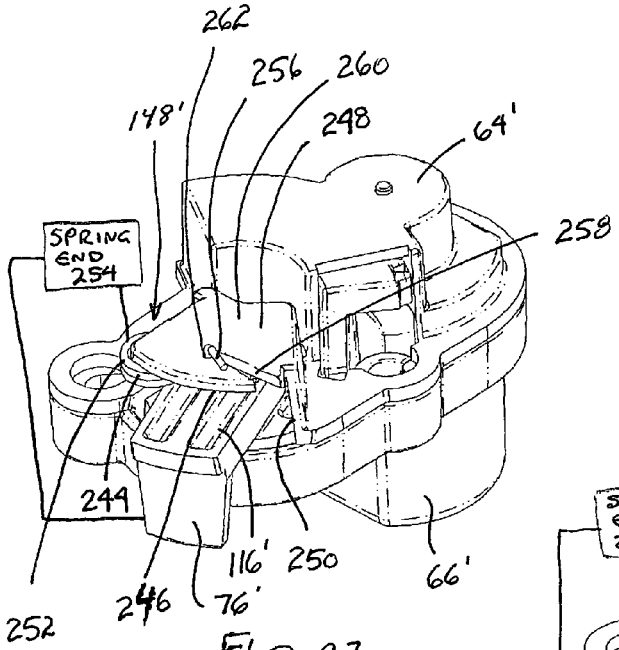
FIG. 27 is a view as in FIG. 26 with the lock cam moved towards its locked position.
Figure 28:
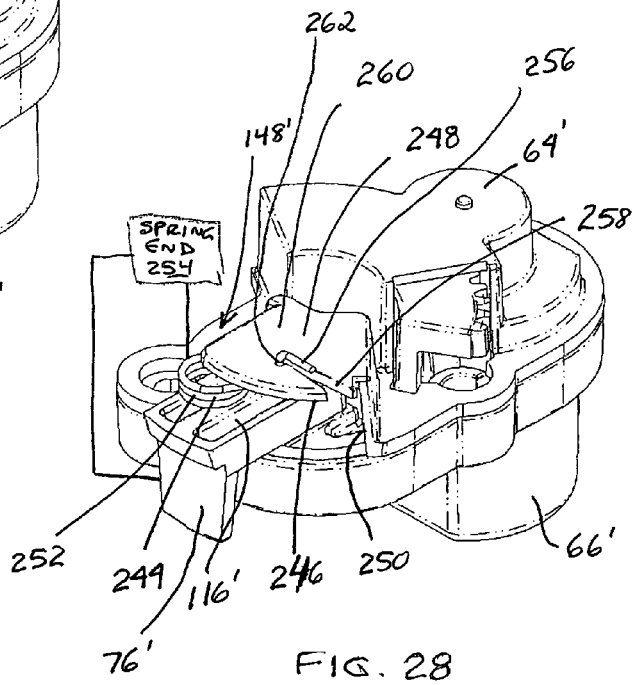
FIG. 28 is a view as in FIGS. 26 and 27 with the lock cam fully in its locked position.

In FIGS. 26-28 a detent arrangement is shown at 148' that is modified from that shown at 148 in FIGS. 12-14. The detent arrangement 148' uses a torsion coil spring 244 that is mounted within a space at 246 bounded by a cup-shaped housing part 248 that is integral with the front housing part 64', opens rearwardly towards the rear housing part 66', and is cut out at 250 to accommodate the cam lock arm 116' as the cam lock 76' is changed between the unlocked position of FIG. 26 and locked position of FIG. 28.

The spring 244 has a coiled body 252 from which oppositely projecting ends 254, 256 extend. One of the spring ends 254 is engaged with the cam lock 76' to follow pivoting movement thereof. The other spring end 256 projects through an elongate slot 258 through a wall 260 of the housing part 248 and nests at the base 262 thereof.

The spring 244 is configured and mounted in an overcenter arrangement whereby the spring 244 resiliently urges the cam lock 76' into each of its locked and unlocked positions. As with the earlier described detent arrangement 148, the detent arrangement 148' avoids inadvertent shifting of the cam lock 76' from the unlocked position into the locked position.

The spring 244 also causes the cam lock 76' to consistently be placed in its locked and unlocked positions. As the cam lock 76' moves in either pivot direction from the transitional FIG. 27 position, it is resiliently driven by the spring 244 towards and into each of the locked and unlocked positions of FIGS. 28 and 26, respectively.

The foregoing disclosure of specific embodiments is intended to be illustrative of the broad concepts comprehended by the invention.

The invention claimed is:

1. A system for releasably maintaining a movable closure element in a predetermined position relative to a support therefor, the system comprising:

a latch assembly to engage a part of a support for a movable closure element on which the system is mounted and having a latched state and an unlatched state;

a first actuator assembly having a normal state and a release state, the first actuator assembly and latch assembly operatively interconnected so that the latch assembly is changed from the latched state into the unlatched state as an incident of the first actuator assembly being changed from the normal state into the release state, the first actuator assembly comprising a base assembly and a first handle that is repositionable relative to the base assembly between first and second positions, the first actuator assembly in the normal state with the first handle in the first position and in the release state with the first handle in the second position; and a lock assembly having a locked state and an unlocked state and comprising a locking element that is moved between locked and unlocked positions as the lock assembly is changed between the locked and unlocked states, the lock assembly cooperating with the first actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to move the locking element and thereby change the lock assembly between the locked and unlocked states, the lock assembly further comprising a manual actuator subassembly that is operable to move the locking element between the locked and unlocked positions to change the lock assembly between the locked and unlocked states, wherein the locking element is part of a lock cam that is movable around an axis as the locking element is changed between the locked position and the unlocked position.

2. The system for releasably maintaining a movable closure element in a predetermined position according to claim 1 wherein the first handle is part of a first assembly that moves as one piece relative to the base assembly and with the lock assembly in the locked state the locking element directly engages the first assembly to prevent the first handle from being moved from the first position into the second position.

3. The system for releasably maintaining a movable closure element in a predetermined position according to claim 2 wherein the first assembly is pivotable around a first axis relative to the base assembly.

4. The system for releasably maintaining a movable closure element in a predetermined position according to claim 1 wherein the motor has a shaft with a drive element and the lock cam is directly engaged by the drive element so that as the motor is actuated the locking element is changed between the locked and unlocked positions.

5. The system for releasably maintaining a movable closure element in a predetermined position according to claim 1 wherein the manual actuator subassembly comprises a key operated lock plug.

6. The system for releasably maintaining a movable closure element in a predetermined position according to claim 1 wherein there are cooperating detent components on the lock cam and base assembly that interact as an incident of the cam lock being changed from the locked position into the unlocked position to inhibit movement of the lock cam from out of the locked position.

7. The system for releasably maintaining a movable closure element in a predetermined position according to claim 1 wherein the base assembly comprises a housing defining a compartment for the motor and there is at least one opening in the housing to allow egress of moisture from the compartment.

8. The system for releasably maintaining a movable closure element in a predetermined position according to claim 1 wherein the base assembly has a wall portion defining a chamber, the base assembly further comprises a housing defining a compartment for the motor and the housing is mounted within the chamber.

9. The system for releasably maintaining a movable closure element in a predetermined position according to claim 8 wherein the housing, motor and lock cam define a self-contained module that can be mounted to the wall portion within the chamber.

10. The system for releasably maintaining a movable closure element in a predetermined position according to claim 9 wherein the manual actuator subassembly comprises a key operated lock plug that is part of the self-contained module.

11. The system for releasably maintaining a movable closure element in a predetermined position according to claim 10 wherein the first actuator assembly has a front and rear, the wall portion has a cup shape opening rearwardly and the self-contained module is configured to be assembled by being directed from rear to front into the chamber into an assembled state wherein the lock plug is exposed to be operated at the front of the first actuator assembly.

12. The system for releasably maintaining a movable closure element in a predetermined position according to claim 11 wherein the base assembly further comprises a mounting wall that is integral with the wall portion and defines a mounting surface that can be placed facially against a movable closure element to mount the first actuator assembly to a movable closure element.

13. The system for releasably maintaining a movable closure element in a predetermined position according to claim 12 wherein the first handle is configured to be surroundingly grasped by a hand of a user and is mounted to the mounting wall for pivoting movement relative to the mounting wall between the first and second positions.

14. The system for releasably maintaining a movable closure element in a predetermined position according to claim 13 wherein the first handle has a cantilevered projection that extends into the chamber, the cantilevered projection having a shoulder, the lock cam cooperating with the shoulder on the cantilevered projection to block movement of the first handle from the first position into the second position with the lock assembly in the locked state.

15. The system for releasably maintaining a movable closure element in a predetermined position according to claim 12 wherein the wall portion and mounting wall are formed as one piece.

16. The system for releasably maintaining a movable closure element in a predetermined position according to claim 1, further in combination with a movable closure element having first and second sides and a second actuator assembly, the first actuator assembly mounted on the first side of the movable closure element and the second actuator assembly mounted on the second side of the movable closure element, the second actuator assembly having normal and release states and configured to change the latch assembly from the latched state into the unlatched state as an incident of the second actuator assembly being changed from its normal state into its release state.

17. The system for releasably maintaining a movable closure element in a predetermined position according to claim 16 wherein the first actuator assembly has a cantilevered projection that is moved in a substantially linear path as the first actuator assembly is changed between its normal and release states and the second actuator comprises a push button actuator with a translatable component that causes the cantilevered projection to move in the substantially linear path as the second actuating assembly is changed between its normal and release states.

18. The system for releasably maintaining a movable closure element in a predetermined position according to claim 1, further in combination with a vehicle and a movable closure element on the vehicle to which the closure element is mounted for movement between open and closed positions, wherein there is a secondary actuator assembly that causes the motor to be automatically controlled in response to the detection of a condition that warrants either: a) maintaining of the state of the lock assembly; or b) changing of the state of the lock assembly.

19. The system for releasably maintaining a movable closure element in a predetermined position according to claim 18 wherein the condition that warrants changing of the state of the lock assembly comprises at least one of: a) an external force resulting from an impact to the vehicle; b) situation of the closure element in a partially closed state; c) situation of the closure element in the open position; d) malfunction of a component of the vehicle; e) the presence of excessive heat; f) the presence of smoke; and g) the presence of an obstruction that interferes with movement of the closure element.

20. The system for releasably maintaining a movable closure element in a predetermined position according to claim 1, further in combination with a remote secondary actuator assembly through which the motor can be actuated.

21. A system for releasably maintaining a movable closure element in a predetermined position relative to a support therefor, the system comprising:

a latch assembly to engage a part of a support for a movable closure element on which the system is mounted and having a latched state and an unlatched state;

a first actuator assembly having a normal state and a release state, the first actuator assembly and latch assembly operatively interconnected so that the latch assembly is changed from the latched state into the unlatched state as an incident of the first actuator assembly being changed from the normal state into the release state, the first actuator assembly comprising a base assembly and a first handle that is repositionable relative to the base assembly between first and second positions, the first actuator assembly in the normal state with the first handle in the first position and in the release state with the first handle in the second position; and a lock assembly having a locked state and an unlocked state and comprising a locking element that is moved between locked and unlocked positions as the lock assembly is changed between the locked and unlocked states, the lock assembly cooperating with the first actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to move the locking element and thereby change the lock assembly between the locked and unlocked states, the lock assembly further comprising a manual actuator subassembly that is operable to move the locking element between the locked and unlocked positions to change the lock assembly between the locked and unlocked states, wherein the first handle is part of a first assembly that moves as one piece relative to the base assembly and with the lock assembly in the locked state the locking element directly engages the first assembly to prevent the first handle from being moved from the first position into the second position, wherein the first assembly is pivotable around a first axis relative to the base assembly, the locking element is part of a lock cam that is movable around a second axis as the locking element is changed between the locked position and the unlocked position, and the first and second axes are transverse to each other.

22. A system for releasably maintaining a movable closure element in a predetermined position relative to a support therefor, the system comprising:

a latch assembly to engage a part of a support for a movable closure element on which the system is mounted and having a latched state and an unlatched state;

a first actuator assembly having a normal state and a release state, the first actuator assembly and latch assembly operatively interconnected so that the latch assembly is changed from the latched state into the unlatched state as an incident of the first actuator assembly being changed from the normal state into the release state, the first actuator assembly comprising a base assembly and a first handle that is repositionable relative to the base assembly between first and second positions, the first actuator assembly in the normal state with the first handle in the first position and in the release state with the first handle in the second position; and a lock assembly having a locked state and an unlocked state and comprising a locking element that is moved between locked and unlocked positions as the lock assembly is changed between the locked and unlocked states, the lock assembly cooperating with the first actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to move the locking element and thereby change the lock assembly between the locked and unlocked states, the lock assembly further comprising a manual actuator subassembly that is operable to move the locking element between the locked and unlocked positions to change the lock assembly between the locked and unlocked states, wherein the first handle is part of a first assembly that moves as one piece relative to the base assembly and with the lock assembly in the locked state the locking element directly engages the first assembly to prevent the first handle from being moved from the first position into the second position, wherein the locking element is part of a lock cam that is movable around an axis as the locking element is changed between the locked position and the unlocked position, the first assembly has a receptacle bounded by a shoulder and with the lock assembly in the locked state the locking element is situated to abut the shoulder to thereby block movement of the first handle from the first position into the second position.

23. A system for releasably maintaining a movable closure element in a predetermined position relative to a support therefor, the system comprising:

a latch assembly to engage a part of a support for a movable closure element on which the system is mounted and having a latched state and an unlatched state;

a first actuator assembly having a normal state and a release state, the first actuator assembly and latch assembly operatively interconnected so that the latch assembly is changed from the latched state into the unlatched state as an incident of the first actuator assembly being changed from the normal state into the release state, the first actuator assembly comprising a base assembly and a first handle that is repositionable relative to the base assembly between first and second positions, the first actuator assembly in the normal state with the first handle in the first position and in the release state with the first handle in the second position; and a lock assembly having a locked state and an unlocked state and a locking element that is moved between locked and unlocked positions as the lock assembly is changed between the locked and unlocked states, the lock assembly cooperating with the first actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to change the lock assembly between the locked and unlocked states, wherein the locking element is part of a lock cam that is movable around an axis as the locking element is changed between the locked position and the unlocked position, wherein the motor has a shaft with a drive element and the lock cam is directly engaged by the drive element so that as the motor is actuated the locking element is changed between the locked and unlocked positions, wherein the drive element comprises teeth and the lock cam comprises teeth that are directly meshed with the teeth on the drive element.

24. A system for releasably maintaining a movable closure element in a predetermined position relative to a support therefor, the system comprising:

a latch assembly to engage a part of a support for a movable closure element on which the system is mounted and having a latched state and an unlatched state;

a first actuator assembly having a normal state and a release state, the first actuator assembly and latch assembly operatively interconnected so that the latch assembly is changed from the latched state into the unlatched state as an incident of the first actuator assembly being changed from the normal state into the release state, the first actuator assembly comprising a base assembly and a first handle that is repositionable relative to the base assembly between first and second positions, the first actuator assembly in the normal state with the first handle in the first position and in the release state with the first handle in the second position; and a lock assembly having a locked state and an unlocked state and comprising a locking element that is moved between locked and unlocked positions as the lock assembly is changed between the locked and unlocked states, the lock assembly cooperating with the first actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to move the locking element and thereby change the lock assembly between the locked and unlocked states, the lock assembly further comprising a manual actuator subassembly that is operable to move the locking element between the locked and unlocked positions to change the lock assembly between the locked and unlocked states, wherein the lock assembly comprises a manual actuator subassembly that is operable to change the lock assembly between the locked and unlocked states, wherein the manual actuator subassembly comprises a key operated lock plug, wherein the locking element comprises a lock cam that is movable around an axis as the locking element is moved between the locked position and the unlocked position.

25. The system for releasably maintaining a movable closure element in a predetermined position according to claim 24 wherein the key operated lock plug comprises a housing with a cylinder that accepts an access key and can be pivoted around an axis through the access key to thereby change an actuating projection between locking and unlocking positions, the actuating projection cooperating with the lock cam to cause the locking element to be changed from the unlocked position into the locked position as an incident of the actuating projection being changed from the unlocking position into the locking position.

26. A system for releasably maintaining a movable closure element in a predetermined position relative to a support therefor, the system comprising:

a latch assembly to engage a part of a support for a movable closure element on which the system is mounted and having a latched state and an unlatched state;

a first actuator assembly having a normal state and a release state, the first actuator assembly and latch assembly operatively interconnected so that the latch assembly is changed from the latched state into the unlatched state as an incident of the first actuator assembly being changed from the normal state into the release state, the first actuator assembly comprising a base assembly and a first handle that is repositionable relative to the base assembly between first and second positions, the first actuator assembly in the normal state with the first handle in the first position and in the release state with the first handle in the second position; and a lock assembly having a locked state and an unlocked state and a locking element that is moved between locked and unlocked positions as the lock assembly is changed between the locked and unlocked states, the lock assembly cooperating with the first actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to change the lock assembly between the locked and unlocked states, wherein the lock assembly comprises a manual actuator subassembly that is operable to change the locking element between the locked and unlocked positions, wherein the manual actuator subassembly comprises a key operated lock plug, wherein the locking element is part of a lock cam movable around an axis as the locking element is changed between the locked position and the unlocked position, wherein the key operated lock plug comprises a housing with a cylinder that accepts an access key and can be pivoted around an axis through the access key to thereby change an actuating projection between locking and unlocking positions, the actuating projection cooperating with the lock cam to cause the locking element to be changed from the unlocked position into the locked position as an incident of the actuating projection being changed from the unlocking position into the locking position, wherein the lock cam has a slot within which the actuating projection extends and the actuating projection and slot in the lock cam are configured to define a lost motion connection therebetween whereby the locking element can be changed between the locked and unlocked positions through actuation of the motor without repositioning the actuating projection between the locking and unlocking positions.

27. A system for releasably maintaining a movable closure element in a predetermined position relative to a support therefor, the system comprising:

a latch assembly to engage a part of a support for a movable closure element on which the system is mounted and having a latched state and an unlatched state;

a first actuator assembly having a normal state and a release state, the first actuator assembly and latch assembly operatively interconnected so that the latch assembly is changed from the latched state into the unlatched state as an incident of the first actuator assembly being changed from the normal state into the release state, the first actuator assembly comprising a base assembly and a first handle that is repositionable relative to the base assembly between first and second positions, the first actuator assembly in the normal state with the first handle in the first position and in the release state with the first handle in the second position; and a lock assembly having a locked state and an unlocked state and a locking element that is moved between locked and unlocked positions as the lock assembly is changed between the locked and unlocked states, the lock assembly cooperating with the first actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to change the lock assembly between the locked and unlocked states, wherein the locking element is part of a lock cam that is movable around an axis as the locking element is changed between the locked position and the unlocked position, wherein the motor has a shaft with a drive element and the lock cam is directly engaged by the drive element so that as the motor is actuated the locking element is changed between the locked and unlocked positions, wherein the drive element comprises teeth, the lock cam comprises teeth, and there is a reduction gear with teeth in mesh with the teeth on each of the drive element and lock cam.

28. An actuator assembly module comprising:

an actuator assembly having a normal state and a release state, the actuator assembly configured to be operatively interconnected with a latch assembly to thereby operate the latch assembly by changing the state of the actuator assembly, the actuator assembly comprising a base assembly and a first handle that is repositionable relative to the base assembly between first and second positions, the actuator assembly in the normal state with the first handle in the first position and in the release state with the first handle in the second position; and a lock assembly having a locked state and an unlocked state and comprising a locking element that is moved between locked and unlocked positions as the lock assembly is changed between the locked and unlocked states, the lock assembly cooperating with the actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to move the locking element and thereby change the lock assembly between the locked and unlocked states, and the lock assembly further comprising a manual actuator subassembly that is operable to move the locking element between the locked and unlocked positions to thereby change the lock assembly between the locked and unlocked states, wherein the first handle is part of a first assembly that moves as one piece relative to the base assembly and with the lock assembly in the locked state the locking element directly engages the first assembly to prevent the first handle from being moved from the first position into the second position, wherein the lock assembly is part of a lock cam that is movable around an axis as the locking element is changed between the locked position with the lock assembly in the locked state and the unlocked position with the lock assembly in the unlocked state, the first assembly has a receptacle bounded by a shoulder and with the lock assembly in the locked state the locking element is situated to abut the shoulder to thereby block movement of the first handle from the first position into the second position.

29. The actuator assembly module according to claim 28 wherein the first handle is part of a first assembly that moves as one piece relative to the base assembly and with the lock assembly in the locked state the locking element directly engages the first assembly to prevent the first handle from being moved from the first position into the second position.

30. The actuator assembly module according to claim 29 wherein the first assembly is pivotable around a first axis relative to the base assembly.

31. The actuator assembly module according to claim 28 wherein the manual actuator subassembly comprises a key operated lock plug and the key operated lock plug comprises a housing with a cylinder that accepts an access key and can be pivoted around an axis through the access key to thereby change an actuating projection between locking and unlocking positions, the actuating projection cooperating with the lock cam to cause the locking element to be changed from the unlocked position into the locked position as an incident of the actuating projection being changed from the unlocking position into the locking position.

32. The actuator assembly module according to claim 28, further in combination with a latch assembly with which the actuator assembly is operatively interconnected.

33. An actuator assembly module comprising:

an actuator assembly having a normal state and a release state, the actuator assembly configured to be operatively interconnected with a latch assembly to thereby operate the latch assembly by changing the state of the actuator assembly, the actuator assembly comprising a base assembly and a first handle that is repositionable relative to the base assembly between first and second positions, the actuator assembly in the normal state with the first handle in the first position and in the release state with the first handle in the second position; and a lock assembly having a locked state and an unlocked state and comprising a locking element that is moved between the locked and unlocked positions as the lock assembly is changed between the locked and unlocked states, the lock assembly cooperating with the actuator assembly and: a) in the locked state the locking element is in the locked position and prevents the first handle from being changed from the first position into the second position; and b) in the unlocked state the locking element is in the unlocked position and allows the first handle to be changed from the first position into the second position, the lock assembly comprising a motor that is actuatable to change the lock assembly between the locked and unlocked states, wherein the first handle is part of a first assembly that moves as one piece relative to the base assembly and with the lock assembly in the locked state the locking element directly engages the first assembly to prevent the first handle from being moved from the first position into the second position, wherein the locking element is part of a lock cam that is movable around an axis as the locking element is changed between the locked position and an unlocked position, wherein the first assembly has a receptacle bounded by a shoulder and with the lock assembly in the locked state the locking element is situated to abut the shoulder to thereby block movement of the first handle from the first position into the second position, wherein the lock assembly comprises a manual actuator subassembly that is operable to change the lock assembly between the locked and unlocked states, wherein the manual actuator subassembly comprises a key operated lock plug and the key operated lock plug comprises a housing with a cylinder that accepts an access key and can be pivoted around an axis through the access key to thereby change an actuating projection between locking and unlocking positions, the actuating projection cooperating with the lock cam to cause the locking element to be changed from the unlocked position into the locked position as an incident of the actuating projection being changed from the unlocking position into the locking position, wherein the lock cam has a slot within which the actuating projection extends and the actuating projection and slot in the lock cam are configured to define a lost motion connection therebetween whereby the locking element can be changed between the locked and unlocked positions through actuation of the motor without repositioning the actuating projection between the locking and unlocking positions.

34. The actuator assembly module according to claim 33 wherein the base assembly has a wall portion defining a chamber, the base assembly further comprises a housing defining a compartment for the motor, and the housing is mounted within the chamber.

35. The actuator assembly module according to claim 34 wherein the housing, motor and lock cam define a self-contained module that can be mounted to the wall portion within the chamber.

36. The actuator assembly module according to claim 35 wherein the actuator assembly has a front and rear, the wall portion has a cup shape opening rearwardly and the self-contained module is configured to be assembled by being directed from rear to front into the chamber into an assembled state wherein the lock plug is exposed to be operated at the front of the first actuator assembly.

37. The actuator assembly module according to claim 36 wherein the first handle has a cantilevered projection that extends into the chamber, the cantilevered projection having a shoulder, the lock cam cooperating with the shoulder on the cantilevered projection to block movement of the first handle from the first position into the second position with the lock assembly in the locked state.

38. The actuator assembly module according to claim 37 wherein the wall portion and mounting wall are formed as one piece.

* * * * *